US010787330B2

(12) United States Patent
Aoki

(10) Patent No.: US 10,787,330 B2
(45) Date of Patent: Sep. 29, 2020

(54) RECORDING APPARATUS

(71) Applicant: SEIKO EPSON CORPORATION, Tokyo (JP)

(72) Inventor: Takeshi Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/287,469

(22) Filed: Feb. 27, 2019

(65) Prior Publication Data

US 2019/0263610 A1 Aug. 29, 2019

(30) Foreign Application Priority Data

Feb. 28, 2018 (JP) ..... 2018-035275

(51) Int. Cl.

| | |
|---|---|
| ***B65H 1/12*** | (2006.01) |
| ***B65H 1/26*** | (2006.01) |
| ***B65H 3/06*** | (2006.01) |
| ***B41J 11/00*** | (2006.01) |
| ***B65H 3/24*** | (2006.01) |
| ***B65H 1/24*** | (2006.01) |
| ***B65H 1/04*** | (2006.01) |

(52) U.S. Cl.

CPC ..... *B65H 3/0684* (2013.01); *B41J 11/007* (2013.01); *B65H 1/04* (2013.01); *B65H 1/12* (2013.01); *B65H 1/24* (2013.01); *B65H 1/266* (2013.01); *B65H 3/0615* (2013.01); *B65H 3/24* (2013.01); *B65H 2405/1117* (2013.01); *B65H 2511/12* (2013.01)

(58) Field of Classification Search

CPC . B65H 1/12; B65H 1/04; B65H 1/266; B65H 1/24; B65H 2511/12; B65H 2405/1117

See application file for complete search history.

(56) References Cited

U.S. PATENT DOCUMENTS

2004/0169328 A1* 9/2004 Guddanti ..... B65H 1/266 271/147

2018/0179000 A1 6/2018 Morisawa et al.

FOREIGN PATENT DOCUMENTS

JP 04169423 A * 6/1992
JP 2004-331345 A 11/2004
JP 2018-104200 A 7/2018

* cited by examiner

*Primary Examiner* — Luis A Gonzalez
(74) *Attorney, Agent, or Firm* — Workman Nydegger

(57) ABSTRACT

A recording apparatus includes a placement unit on which sheets of paper are placed, a feeder that feeds a sheet, thrust mechanisms that push up the placement unit toward the feeder, and an edge guide. Each of the thrust mechanisms includes a coil spring that imparts an urging force to the placement unit, one case that is mounted on the placement unit and receives the coil spring from one end thereof and accommodates the coil spring, and another case that is disposed so as to partially overlap the one case and receives the coil spring from the other end thereof and accommodates the coil spring. The one case and the other case are configured to be movable relative to each other in the urging direction of the coil spring and to be rotatable together in the circumferential direction.

11 Claims, 25 Drawing Sheets

RECORDING APPARATUS

BACKGROUND

1. Technical Field

The present invention relates to a recording apparatus provided with an urging member that urges a recording medium placed on a placement unit toward a feeder.

2. Related Art

A known example of the recording apparatus of this type is an apparatus disclosed, for example, in JP-A-2004-331345. The recording apparatus of this type includes a paper cassette, a feed roller disposed in a region above the paper cassette, an intermediate plate that is disposed inside the paper cassette and on which sheets of paper are stacked, and first to third springs that urge the intermediate plate upward. A spring cap is disposed on the top face of the second spring. Inside the paper cassette, a pair of side regulation plates and a spring lock member are provided. A pair of the side regulation plates are movable so as to fit the size of sheets placed on the intermediate plate. The spring lock member engages the side regulation plates and is movable in a direction of transporting a sheet.

The spring lock member moves between a first position and a second position. The first position is a position at which the spring lock member is separated from the spring cap due to a balance between an urging force of a tension spring and a pressing force generated in conjunction with movement of the side regulation plates, and the spring lock member thereby permits the second spring to impart an urging force to the intermediate plate. The second position is a position at which the spring lock member engages the spring cap and thereby restrains the second spring from imparting the urging force to the intermediate plate. When the side regulation plates are moved to a position so as to fit large size sheets, the intermediate plate is pushed upward by the urging forces of the first spring, the second spring, and the third spring, which thereby generates a relatively large feed pressure (i.e., a contact pressure between the sheets and the feed roller). On the other hand, when the side regulation plates are moved to a position so as to fit small size sheets, the intermediate plate is pushed upward by the urging forces of the first spring and the third spring, which thereby generates a relatively small feed pressure.

However, in the recording apparatus described above, if the engagement state between the spring lock member and the spring cap is terminated due to, for example, an external force while the spring lock member stays at the second position, the second spring, which is disposed in an exposed and unprotected state, may be bent in an unexpected direction by the spring lock member. This may lead to breakage of the second spring.

SUMMARY

An advantage of some aspects of the invention is that a recording apparatus that can protect an urging member that imparts an urging force to a placement unit is provided.

Implementation and advantageous effects will be described. A recording apparatus according to an aspect of the invention includes a placement unit on which a recording medium on which recording is performed in a recording section is placed, a feeder that feeds the recording medium toward the recording section, a thrust mechanism that pushes up the placement unit toward the feeder, and an edge guide that is disposed in the placement unit and defines a position of a side of the recording medium in a direction intersecting a transport direction of the recording medium. In the recording apparatus, the thrust mechanism includes an urging member that imparts an urging force to the placement unit, a first accommodation body that is mounted on the placement unit and receives the urging member from an end thereof and accommodates the urging member, and a second accommodation body that is disposed so as to partially overlap the first accommodation body and receives the urging member from another end thereof and accommodates the urging member. In addition, the first accommodation body and the second accommodation body are movable relative to each other in an urging direction of the urging member and are rotatable together in a circumferential direction of the first accommodation body and the second accommodation body. The recording apparatus also includes a protrusion that is disposed in the first accommodation body and that rotates the first accommodation body in conjunction with movement of the edge guide, and a restrained portion that is disposed in the second accommodation body, that rotates together with the second accommodation body in conjunction with rotation of the first accommodation body, and that is displaced between a first position at which the restraining portion restrains the restrained portion and a second position at which the restraining portion does not restrain the restrained portion. In the recording apparatus, in a case in which the restrained portion is at the first position, the second accommodation body is restrained from moving relative to the first accommodation body, and the urging member is thereby restrained from imparting the urging force to the placement unit.

With this configuration, the urging member that imparts an urging force to the placement unit is covered by the first accommodation body and the second accommodation body, and thereby the urging member can be protected. It is preferable that the recording apparatus include a second urging member that urges the placement unit and the recording medium placed on the placement unit toward the feeder.

With this configuration, the urging forces imparted to the placement unit can be set suitably to fit recording media of a plurality of sizes. It is preferable that the recording apparatus further include two thrust mechanisms and a slide member that moves in conjunction with movement of the edge guide and is able to come into contact with the respective protrusions of the two thrust mechanisms, and that the slide member selectively restrain the respective urging members of the two thrust mechanisms from imparting the urging forces to the placement unit in accordance with a position to which the slide member has been moved.

With this configuration, a single slide member can selectively restrain two thrust mechanisms from functioning, which leads to a reduction in the number of parts. In the recording apparatus, it is preferable that the placement unit be configured to be rotatable around a pivot shaft, that the two thrust mechanisms be arranged adjacent to each other in a direction orthogonally intersecting an axial direction of the pivot shaft, and that in a case in which a pair of the edge guides are moved from positions that are away from each other to positions that are closer to each other, the urging member of one of the two thrust mechanisms that is located further away from the pivot shaft in the direction orthogonally intersecting the axial direction of the pivot shaft be restrained from imparting the urging force to the placement unit before the urging member of another one of the two thrust mechanisms that is located closer to the pivot shaft in the direction orthogonally intersecting the axial direction of the pivot shaft is restrained from imparting the urging force to the placement unit.

With this configuration, when the thrust mechanisms push up the placement unit and the recording medium placed thereon toward the feeder, the push-up forces can be adjusted appropriately in accordance with the size of the recording medium.

In the recording apparatus, it is preferable that the placement unit be configured to be rotatable around the pivot shaft, that the two thrust mechanisms be arranged adjacent to each other in the direction orthogonally intersecting the axial direction of the pivot shaft, and that the urging member of one of the two thrust mechanisms that is located further away from the pivot shaft in the direction orthogonally intersecting the axial direction of the pivot shaft provide a larger urging force than the urging member of another one of the two thrust mechanisms that is located closer to the pivot shaft in the direction orthogonally intersecting the axial direction of the pivot shaft.

With this configuration, when the placement unit is rotated around the pivot shaft, the urging members can impart the urging forces to the placement unit efficiently. It is preferable that the recording apparatus further include an abutment portion with which the second accommodation body comes into contact in a case in which the urging member imparts the urging force to the placement unit, and that the second accommodation body have a contact portion that is shaped like a hemisphere and comes into contact with the abutment portion.

With this configuration, even if the contact angle of the second accommodation body against the abutment portion changes slightly, changes in the urging force of the urging member that acts on the placement unit can be suppressed. In the recording apparatus, it is preferable that in a state in which the placement unit and the recording medium placed thereon are pushed up toward the feeder by the thrust mechanism, a pair of the edge guides be permitted to move in a direction away from each other.

With this configuration, when a recording medium is jammed between a pair of the edge guides, a pair of the edge guides can be moved in the direction away from each other so that the jammed recording medium can be removed easily.

In the recording apparatus, it is preferable that in a state in which the placement unit and the recording medium placed thereon are pushed up toward the feeder by the thrust mechanism, the restraining portion restrain the restrained portion from rotating, and a pair of the edge guides be thereby restrained from moving in a direction closer to each other.

With this configuration, after the second accommodation body moves relative to the first accommodation body, the restraining portion and the restrained portion are restrained from overlapping each other in the relative movement direction of the second accommodation body, which can restrain the second accommodation body from failing to return to the original position prior to the relative movement.

In the recording apparatus, it is preferable that the first accommodation body have a first engagement portion that extends in an urging direction of the urging member, and that the second accommodation body have a second engagement portion that extends in the urging direction of the urging member and engages the first engagement portion.

With this configuration, the first accommodation body and the second accommodation body can rotate together in the rotation direction of the protrusion while causing the first accommodation body and the second accommodation body to move relative to each other in the urging direction of the urging member. Thus, the protrusion of the first accommodation body and the restrained portion of the second accommodation body are restrained from being shifted in phase in the rotation direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
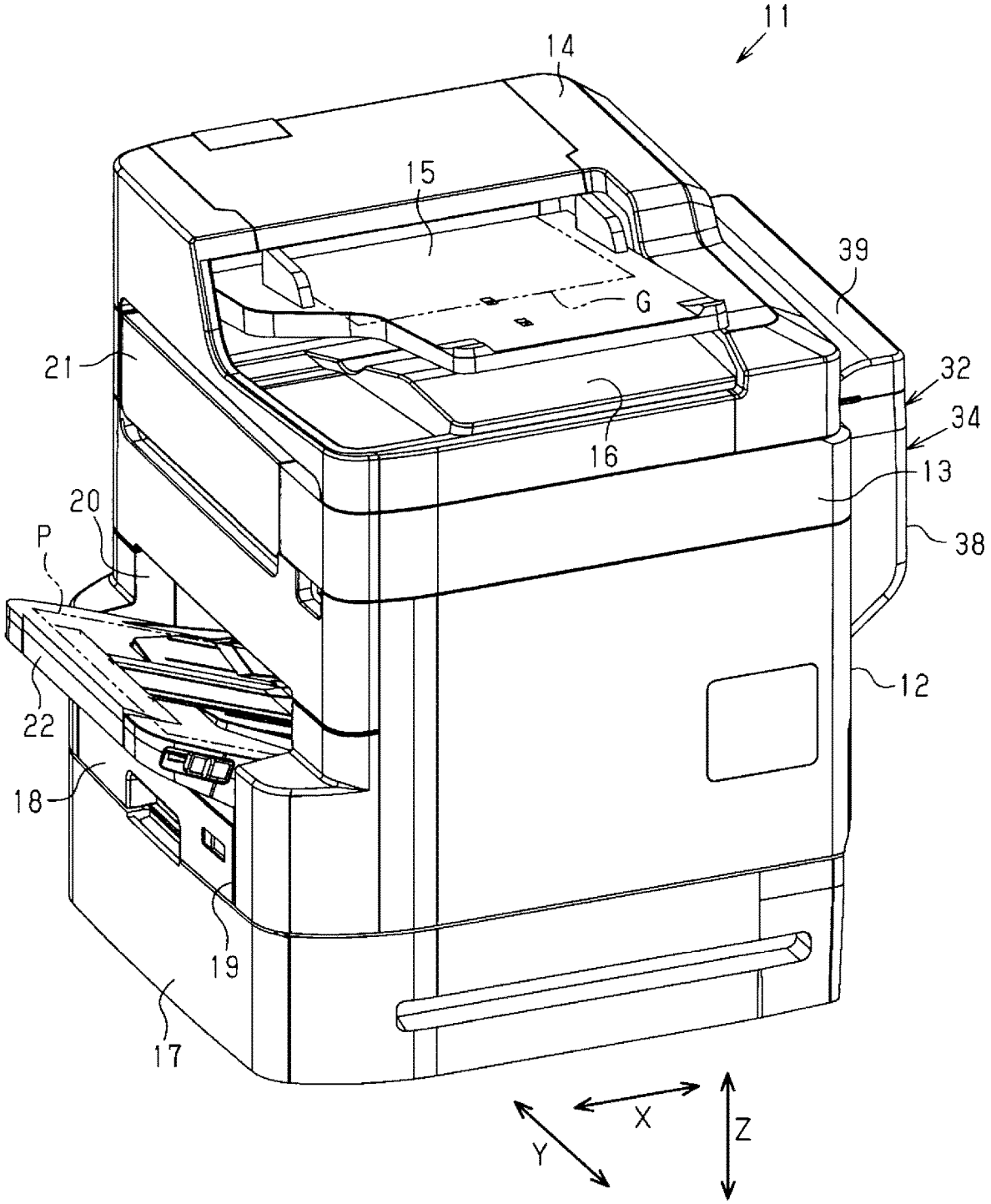
FIG. 1 is a perspective view illustrating an ink jet type printer according to an embodiment.

An embodiment of a recording apparatus will be described with reference to the drawings. As illustrated in FIG. 1, an ink jet type printer 11, which is an example of a recording apparatus, includes a casing 12 that has a predetermined height, a predetermined depth, and a predetermined width when placed on a horizontal placement surface. The ink jet type printer 11 also includes a document reader 13 disposed on the casing 12 and an auto document feeder 14 disposed on the document reader 13.

The auto document feeder 14 includes a document-setting section 15 in which a plurality of documents G can be stacked and a discharge section 16 that is disposed under the document-setting section 15. A plurality of the document G stacked in the document-setting section 15 is fed one by one to a document transport path (not illustrated) in which each document G is inverted. The document G is subsequently read by a reading section (not illustrated) that is disposed inside the document reader 13 and transported to the discharge section 16.

Disposed on the front side of the casing 12 are, in order from the bottom upward, an openable/closable cover 17, an installation opening 19, and a discharge opening 20. A paper cassette 18 that accommodates sheets of paper P, which are examples of recording media, is detachably installed in the installation opening 19. Each sheet P on which recording (printing) has been performed is discharged from the discharge opening 20. A discharge tray 22 that supports the sheets P discharged from the discharge opening 20 is detachably attached to the discharge opening 20 so as to protrudes frontward. An operation section 21 with which various operations are performed is provided on the front side of the document reader 13. Note that the front side of the casing 12 and the front side of the document reader 13 are sides that have heights and widths and face a user that operates the ink jet type printer 11 normally.

Figure 2:
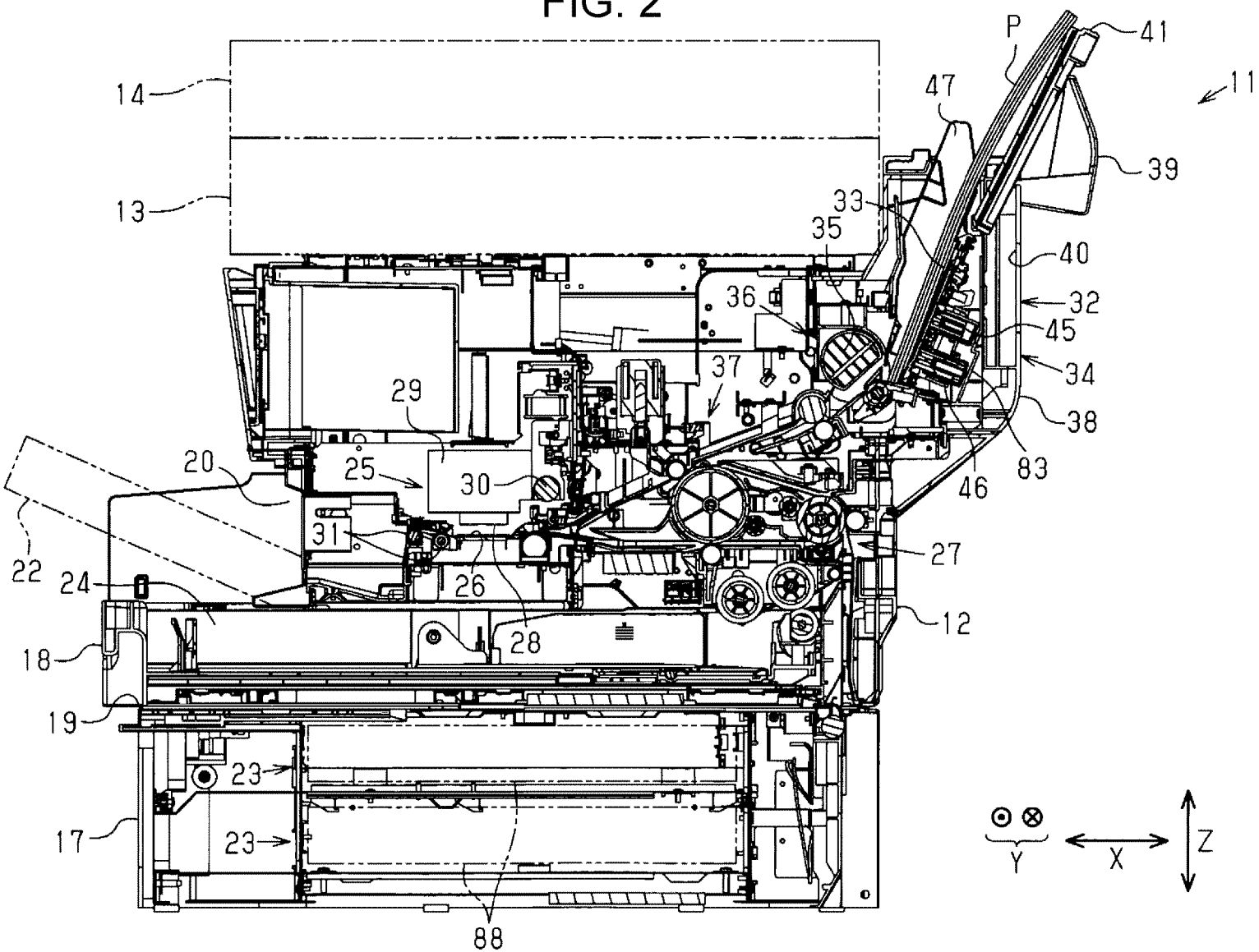
FIG. 2 is a cross-sectional view illustrating the ink jet type printer in FIG. 1.

As illustrated in FIGS. 1 and 2, a mounting section 23, a paper accommodation section 24, and a recording section 25 are disposed at respective positions behind the cover 17, the installation opening 19, and the discharge opening 20 inside the casing 12. A container 88 that contains ink packs with ink (i.e., an example of liquid) filled therein is detachably mounted on the mounting section 23. The paper accommodation section 24 is a portion of the paper cassette 18 that accommodates sheets of paper P. The recording section 25 performs recording onto each sheet P. The cover 17 openably covers the front side of the mounting section 23.

Note that in the present embodiment, the depth direction X is defined as the direction from the front side of the casing 12 toward the opposite side (i.e., rear side) or from the rear side toward the front side. The width direction Y is defined as the direction that orthogonally intersects both the depth direction X and the vertical direction Z. The width direction Y and the depth direction X are substantially parallel to a horizontal plane.

A support platform 26 that supports a sheet P is disposed in a region above the paper accommodation section 24 in the casing 12. Sheets P that are stacked in the paper accommodation section 24 are inverted one by one and transported onto the support platform 26 by a first transport section 27 that includes various types of transport rollers. Flexible tubes (not illustrated) are also disposed inside the casing 12. The ink in the container 88 that is mounted in the mounting section 23 is supplied to the recording section 25 through the flexible tubes by actuating a supply pump (not illustrated).

The recording section 25 includes a recording head 28 that ejects ink supplied from the container 88 via flexible tubes (not illustrated) and a carriage 29 that supports the recording head 28. The carriage 29 is supported by a guide shaft 30 that is suspended in the casing 12 and extends in the width direction Y, and the carriage 29 is able to move reciprocally. In other words, the carriage 29 is configured to move reciprocally in the width direction Y.

Recording (printing) is performed onto a sheet P in such a manner that while the carriage 29 moves reciprocally in the width direction Y along the guide shaft 30, the recording head 28 ejects ink onto a sheet P that is transported onto the support platform 26. The sheet P on which recording has been performed is discharged from the discharge opening 20 onto the discharge tray 22 by a discharge roller 31.

Figure 3:
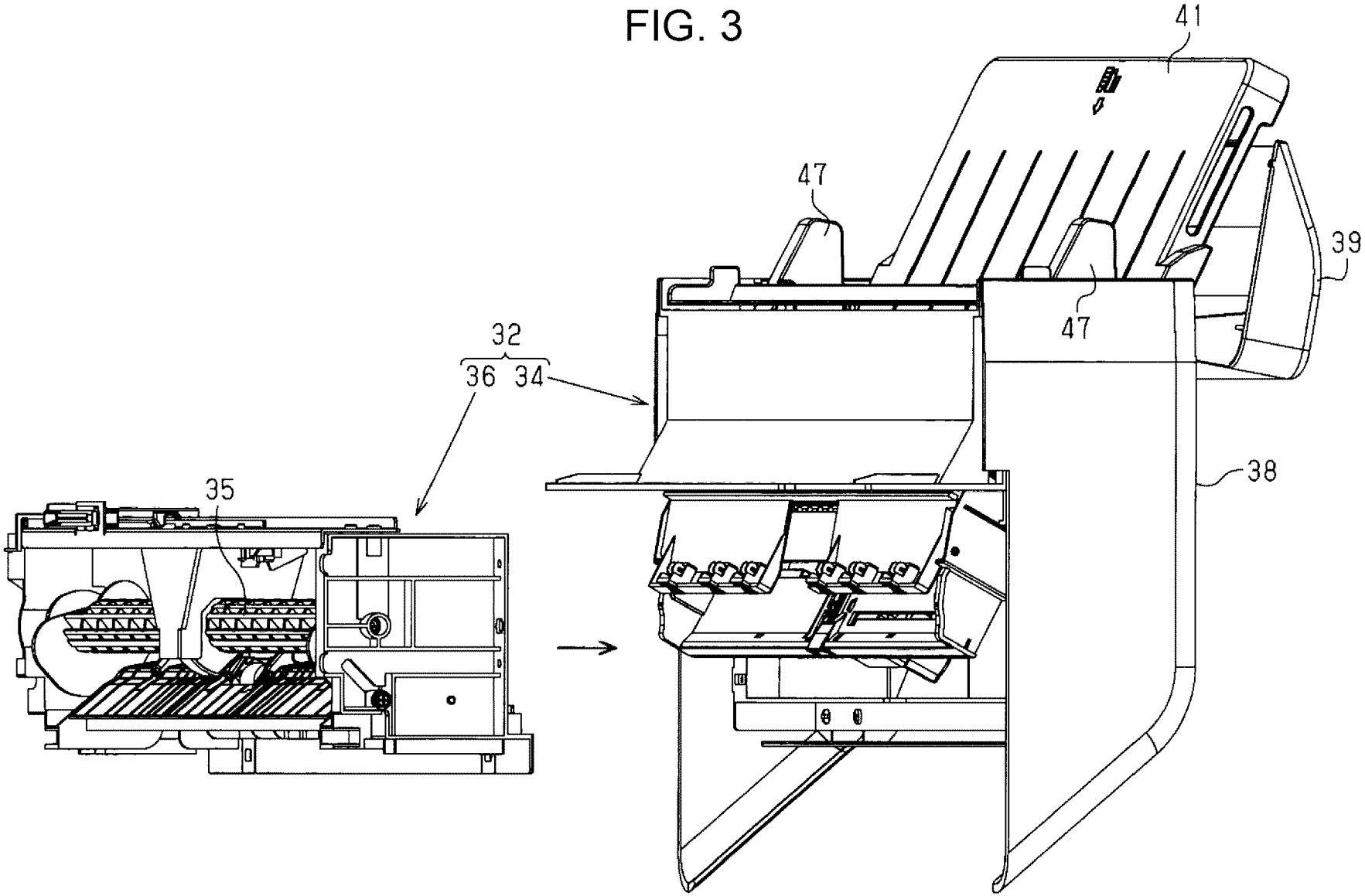
FIG. 3 is an exploded perspective view illustrating a medium feed mechanism.

As illustrated in FIGS. 2 and 3, a medium feed mechanism 32 is provided in an upper rear region in the casing 12 for supporting and transporting sheets P for so-called manual feed printing. The medium feed mechanism 32 includes a medium support unit 34 that can support a plurality of sheets P and a medium feed unit 36. The medium feed unit 36 includes a feed roller 35, which is an example of a feeder. The medium feed unit 36 feeds each of a plurality of sheets P supported by the medium support unit 34 toward the recording section 25.

The medium support unit 34 and the medium feed unit 36 are separate units, but are detachably assembled into one unit. A second transport section 37 is disposed between the support platform 26 and the medium feed unit 36 in the casing 12. The second transport section 37 includes various transport rollers that transport a sheet P that has been fed one by one by the medium feed unit 36 toward the support platform 26.

Figure 4:
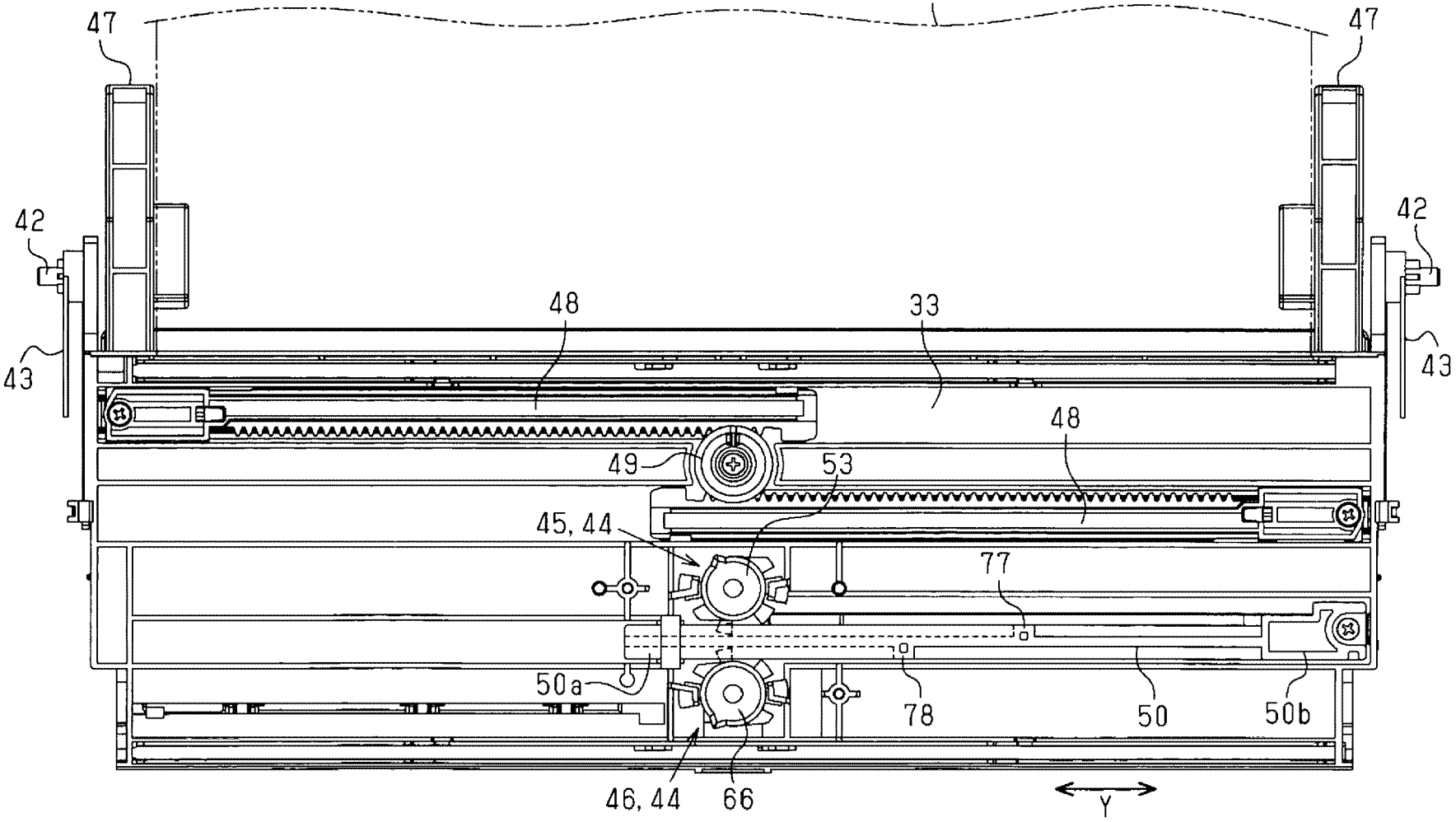
FIG. 4 is a rear view illustrating a placement unit.

As illustrated in FIGS. 2 and 4, the medium support unit 34 includes a housing 38 of which the top end is open and a lid member 39 that openably covers the top end opening of the housing 38. Inside the housing 38, a placement unit 33, an accommodation portion 40 disposed behind the placement unit 33, and an auxiliary tray 41 accommodated in the accommodation portion 40 are disposed. The placement unit 33 is shaped like a board on a front side of which a plurality of sheets P can be stacked. The auxiliary tray 41 can be drawn upward from the accommodation portion 40 when the lid member 39 is open. The auxiliary tray 41 is drawn out of the accommodation portion 40 and supplementally supports a portion of the sheet P that protrudes upward from the placement unit 33.

Pivot shafts 42, which form a pair, are provided at respective upper ends of the placement unit 33 in the width direction Y so as to protrudes outward in the width direction Y. A pair of the pivot shafts 42 are supported rotatably inside the housing 38. Accordingly, the placement unit 33 is configured to be rotatable around a pair of the pivot shafts 42. The bottom end of the front side of the placement unit 33, which is the side on which sheets P are placed, opposes the feed roller 35 in the depth direction X.

A pair of torsion coil springs 43, which are examples of second urging members, are disposed on a pair of the respective pivot shafts 42. A pair of the torsion coil springs 43 urge the placement unit 33 in a direction in which the bottom end of the rotatable placement unit 33 comes closer toward the feed roller 35. In other words, a pair of the torsion coil springs 43 urge the placement unit 33 and the sheets P placed on the placement unit 33 toward the feed roller 35.

A pressing mechanism (not illustrated) is disposed inside the housing 38. The pressing mechanism includes a cam (not illustrated) that rotates in conjunction with rotation of the feed roller 35. In accordance with the rotating position of the cam, the placement unit 33 is pressed or not pressed by the cam against urging forces of a pair of the torsion coil springs 43 in a direction of the bottom end of the placement unit 33 moving away from the feed roller 35.

When the pressing force from the pressing mechanism (not illustrated) does not act, the placement unit 33 is rotated by the urging forces of a pair of the torsion coil springs 43 to a feed position at which the sheets P placed on the placement unit 33 come into contact with the feed roller 35. On the other hand, when the pressing force by the pressing mechanism (not illustrated) acts, the placement unit 33 is rotated, by the pressing force acting against the urging forces of a pair of the torsion coil springs 43, to a standby position (i.e., home position) at which the sheets P placed on the placement unit 33 are separated from the feed roller 35.

Figure 5:
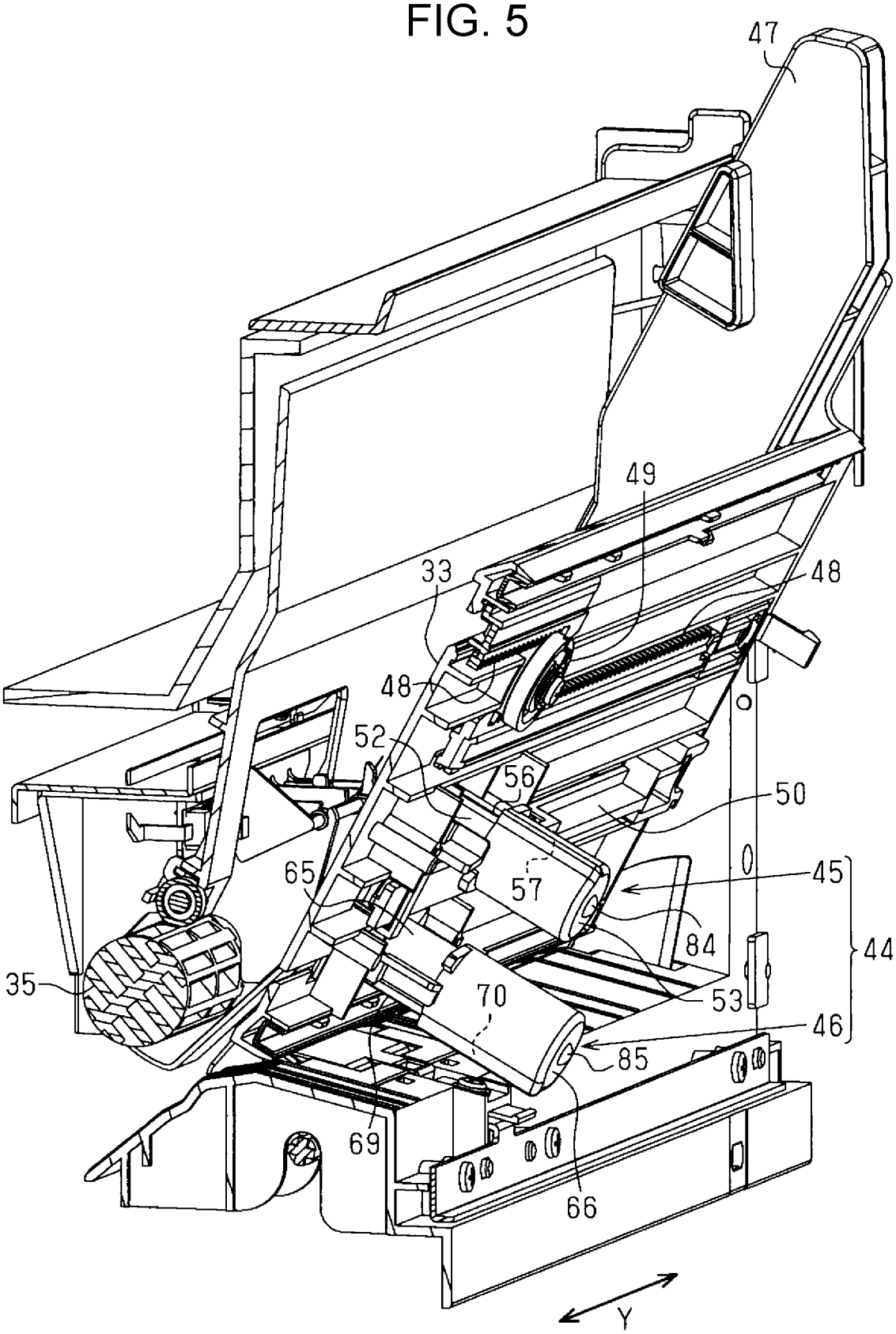
FIG. 5 is a cross-sectional view illustrating the vicinity of the placement unit when viewed from behind.

As illustrated in FIGS. 4 and 5, two thrust mechanisms 44 are provided on the back side of the placement unit 33 in a lower region at the center in the width direction Y. The thrust mechanisms 44 push up the placement unit 33 and the sheets P placed on the front side thereof toward the feed roller 35. Two thrust mechanisms 44 are arranged on the back side of the placement unit 33 with a spacing therebetween in a direction that orthogonally intersects the axial direction of the pivot shafts 42. In other words, two thrust mechanisms 44 are arranged vertically with a spacing therebetween.

One of the two thrust mechanisms 44 that is located at an upper position is denoted by a first thrust mechanism 45, while the other one of the thrust mechanisms 44 that is located at a lower position is denoted by a second thrust mechanism 46. In other words, the first thrust mechanism 45 is disposed at a position closer to the pivot shafts 42 in a direction orthogonally intersecting the axial direction of the pivot shafts 42 than the second thrust mechanism 46, whereas the second thrust mechanism 46 is disposed at a position further away from the pivot shafts 42 in a direction orthogonally intersecting the axial direction of the pivot shafts 42 than the first thrust mechanism 45.

On the front side of the placement unit 33, a pair of edge guides 47 are disposed so as to be reciprocally movable in the width direction Y. The edge guides 47 regulate the positions of respective edges of a sheet P in the width direction Y, which is the direction intersecting the direction of transporting the sheet P. A pair of the edge guides 47 are moved in the width direction Y to respective positions that correspond to the length of a sheet P in the width direction Y. The edge guides 47 thereby guide both edges of the sheet P in the width direction Y. A pair of racks 48 that extend in the width direction Y are arranged vertically adjacent to each other with a spacing therebetween on the back side of the placement unit 33 at positions above the first thrust mechanism 45. Each of a pair of the racks 48 is disposed so as to be movable in the width direction Y.

Between a pair of the racks 48 on the back side of the placement unit 33, a pinion 49 is disposed so as to be rotatable around an axis extending in the direction perpendicular to the back side of the placement unit 33. In the state in which a pair of the edge guides 47 are positioned furthest away from each other in the width direction Y, an end of one of the racks 48 is connected to one of the edge guides 47 and the other end intermeshes with the pinion 49. Simultaneously, an end of the other one of the racks 48 intermeshes with the pinion 49 and the other end is connected to the other one of the edge guides 47.

Accordingly, when one of the edge guides 47 is caused to move in the width direction Y, the force to move the edge guide 47 is transmitted to the other edge guide 47 via a pair of the racks 48 and the pinion 49, which causes the other edge guide 47 to move in the width direction Y. In other words, a pair of the edge guides 47 are caused to move closer to each other or away from each other in the width direction Y synchronously.

A slide member 50 that extends straight in the width direction Y is disposed between the first thrust mechanism 45 and the second thrust mechanism 46 on the back side of the placement unit 33. The slide member 50 is movable in the width direction Y so as to be able to come into contact with the first thrust mechanism 45 and the second thrust mechanism 46. Note that the first thrust mechanism 45 and the second thrust mechanism 46 are configured to be the same substantially and to be shaped in line symmetry with respect to the slide member 50.

In the state in which a pair of the edge guides 47 are positioned furthest away from each other in the width direction Y, a leading end 50*a* of the slide member 50 is positioned between the two thrust mechanisms 44. A base end 50*b* of the slide member 50 is connected to one of the edge guides 47. Accordingly, the slide member 50 moves in the width direction Y in synchronization with the edge guides 47.

Figure 6:
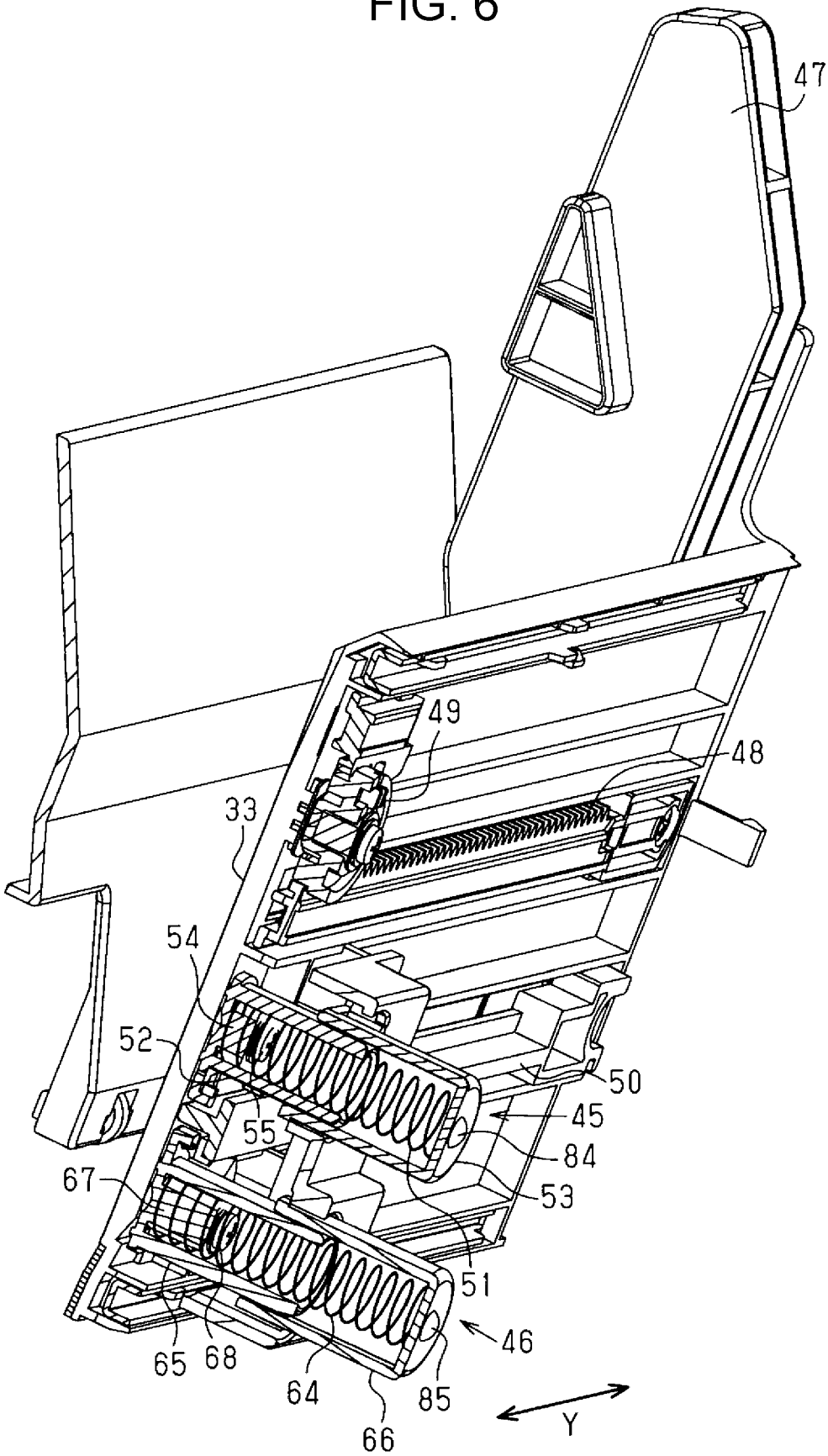
FIG. 6 is a cross-sectional view illustrating the vicinity of the placement unit when viewed from behind.
Figure 7:
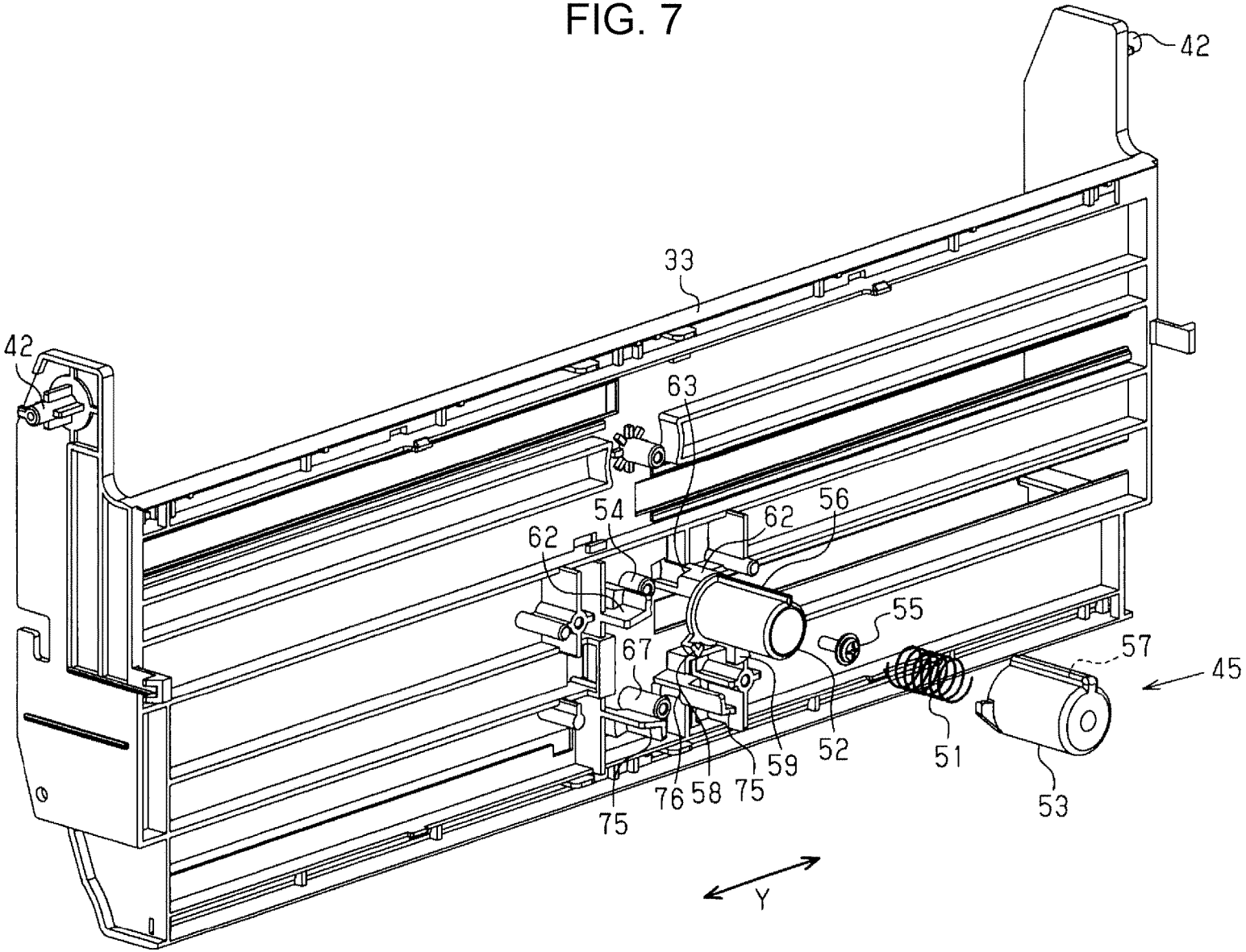
FIG. 7 is an exploded perspective view illustrating the placement unit when viewed from behind.

As illustrated in FIGS. 6 and 7, the first thrust mechanism 45 includes a first coil spring 51, a first upper case 52, and a second upper case 53. The first coil spring 51 is an example of an urging member that imparts an urging force to the placement unit 33. The first upper case 52 is an example of a first accommodation body that accommodates the first coil spring 51 of which one end in the axial direction is inserted into the first accommodation body. The second upper case 53 is an example of a second accommodation body that accommodates the first coil spring 51 of which the other end in the axial direction is inserted into the second accommodation body. Each of the first upper case 52 and the second upper case 53 is shaped like a closed-end cylinder with one end open.

The first upper case 52 is rotatably attached to a cylindrically shaped first boss 54 in such a manner that the closed-end of the first upper case 52, which is opposite to the open end, is attached by a first screw 55 to the first boss 54 disposed on the back side of the placement unit 33. The second upper case 53 is disposed such that a portion of the second upper case 53 overlaps the first upper case 52. In other words, the open end of the first upper case 52 is inserted into the open end of the second upper case 53.

An end of the first coil spring 51 in the axial direction thereof abuts the inside surface of the bottom wall of the first upper case 52, whereas the other end of the first coil spring 51 in the axial direction abuts the inside surface of the bottom wall of the second upper case 53. In this case, the first coil spring 51 is completely covered by the first upper case 52 and the second upper case 53, and in this state, the first coil spring 51 continuously urges the first upper case 52 and the second upper case 53 in directions of separating from each other.

A first upper elongated protrusion 56, which is an example of a first engagement portion, is formed on the outer periphery of the first upper case 52 so as to extend in an urging direction of the first coil spring 51. A second upper groove 57, which is an example of a second engagement portion, is formed on the inner periphery of the second upper case 53 so as to extend in the urging direction of the first coil spring 51 and to be able to receive the first upper elongated protrusion 56.

In the state in which the first upper case 52 is inserted in the second upper case 53 with the first upper elongated protrusion 56 being inserted in the second upper groove 57, the first upper elongated protrusion 56 and the second upper groove 57 are slidable relative to each other in the urging direction of the first coil spring 51, while the first upper elongated protrusion 56 and the second upper groove 57 engage each other in the circumferential direction of the first upper case 52 and the second upper case 53. Accordingly, the first upper case 52 and the second upper case 53 are movable relative to each other in the urging direction of the first coil spring 51 and are rotatable together in the circumferential direction.

Figure 8:
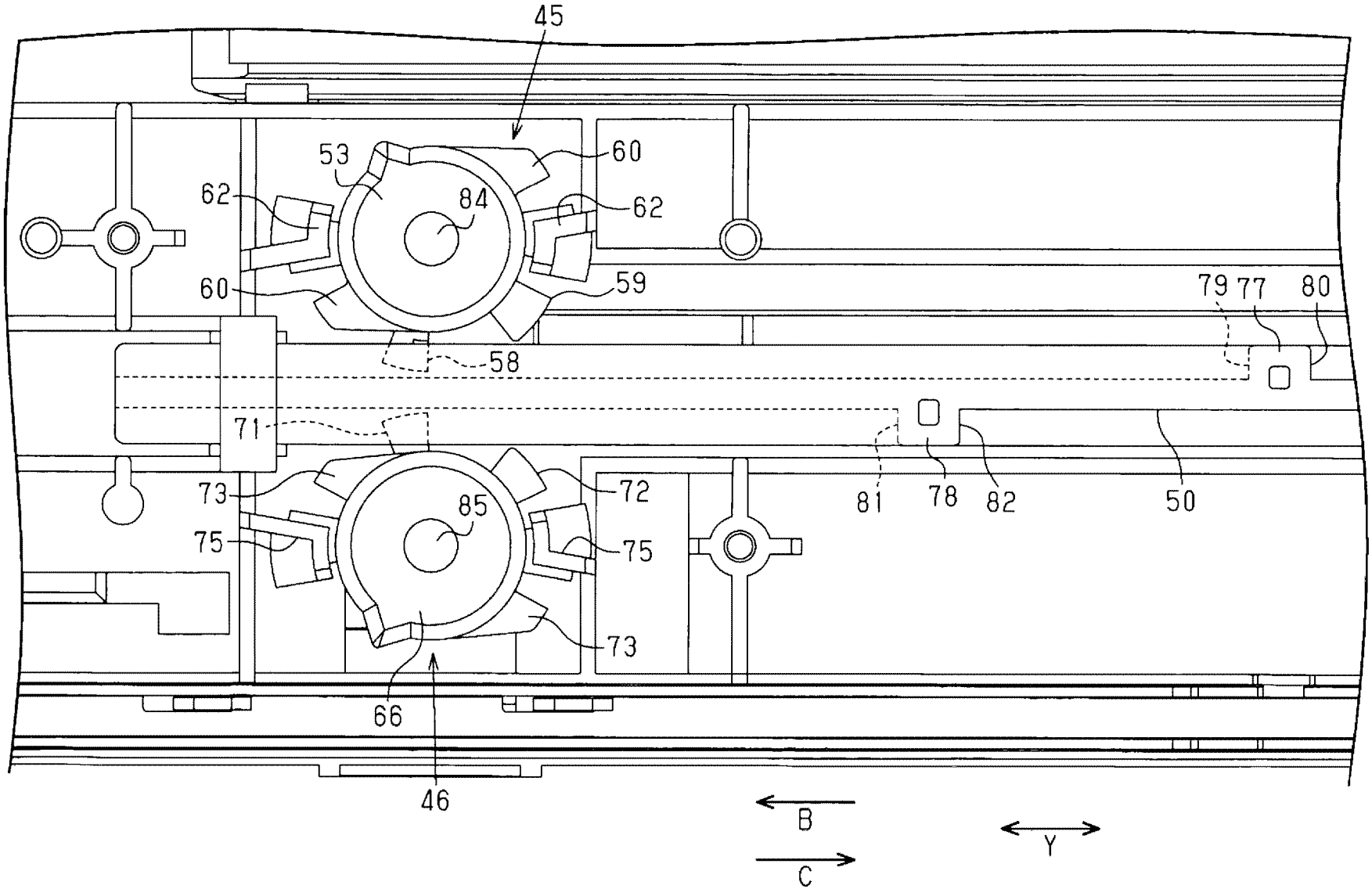
FIG. 8 is an enlarged view illustrating part of the placement unit in FIG. 4.

As illustrated in FIGS. 7 and 8, a first upper rotating protrusion 58 and a second upper rotating protrusion 59 are disposed on the outer periphery of the first upper case 52 at the end near the placement unit 33 so as to protrude in radial directions. The first upper rotating protrusion 58 and the second upper rotating protrusion 59 are examples of a protrusion. The first upper rotating protrusion 58 and the second upper rotating protrusion 59 are disposed so as to be separated from each other by an acute angle (e.g., 70 degrees) in the circumferential direction and to have a slight distance between each other in the axial direction of the first upper case 52. The first upper rotating protrusion 58 and the second upper rotating protrusion 59 come into contact with the slide member 50, which is moved in conjunction with movement of the edge guides 47 (see FIG. 4). The first upper rotating protrusion 58 and the second upper rotating protrusion 59 thereby cause the first upper case 52 to rotate.

Figure 10:
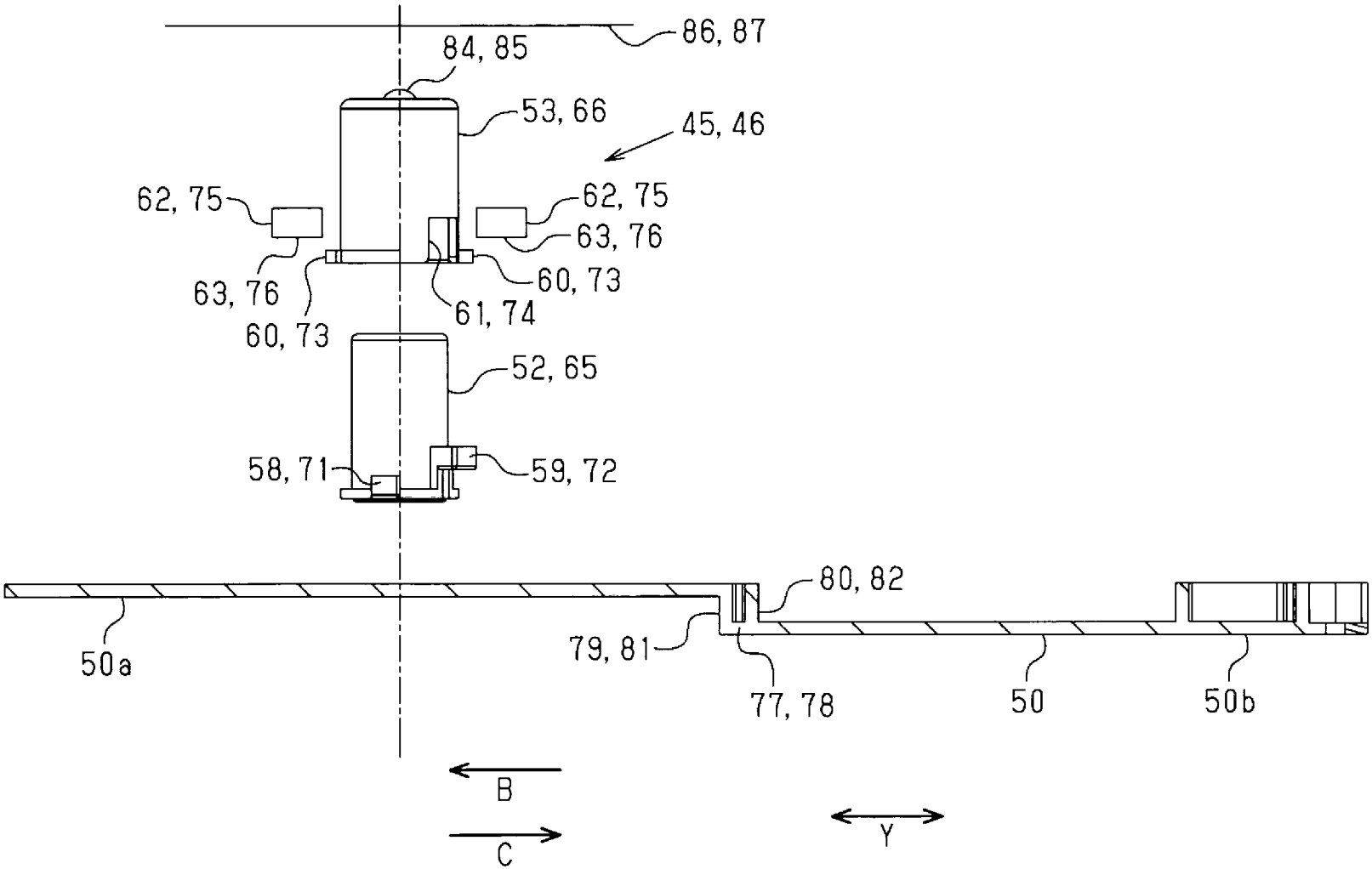
FIG. 10 is a schematic diagram illustrating actions of a first thrust mechanism, a second thrust mechanism, and the slide member.

A pair of first restrained plates 60, which are examples of a restrained portion, are disposed on the outer periphery of the second upper case 53 at the end near the placement unit 33 so as to protrude in radial directions. A pair of the first restrained plates 60 are disposed on opposite sides of the second upper case 53 with the central axis of the second upper case 53 interposed therebetween. A pair of the first restrained plates 60 rotate together with the second upper case 53 in conjunction with rotation of the first upper case 52. Note that as illustrated in FIG. 10, a first mortise 61 is provided at the end of the outer periphery of the second upper case 53 near the placement unit 33 in such a manner that the second upper rotating protrusion 59 of the first upper case 52 protrudes out of the second upper case 53 in a radial direction when the second upper case 53 covers the first upper case 52.

As illustrated in FIGS. 7 and 8, a pair of first restraining portions 62 are disposed on the back side of the placement unit 33 at positions straddling the first thrust mechanism 45 in the width direction Y. The first restraining portions 62 are examples of a restraining portion. Each of the first restraining portions 62 is formed as a plate shaped like a letter L and extends in the axial direction of the first coil spring 51. First restraining surfaces 63 are formed at respective base ends of the first restraining portions 62. The first restraining surfaces 63 can engage the respective first restrained plates 60 in the axial direction of the first coil spring 51 due to rotation of the second upper case 53.

Due to the rotation of a pair of the first restrained plates 60 in conjunction with rotation of the second upper case 53, a pair of the first restrained plates 60 engage respective first restraining surfaces 63 of a pair of the first restraining portions 62 in the axial direction of the first coil spring 51. As a result, the urging force of the first coil spring 51 restrains the first upper case 52 and the second upper case 53 from moving relative to each other in the axial direction of the first coil spring 51. In other words, the first restrained plates 60 rotate together with the second upper case 53 in conjunction with rotation of the first upper case 52, and thereby the first restrained plates 60 are displaced to a first position (a position illustrated in FIG. 12) at which the first restrained plates 60 are restrained by the first restraining portions 62 and to a second position (a position illustrated in FIG. 10) at which the first restrained plates 60 are not restrained by the first restraining portions 62.

As illustrated in FIGS. 5 and 6, the second thrust mechanism 46 includes a second coil spring 64, a first lower case 65, and a second lower case 66. The second coil spring 64 is an example of an urging member that imparts an urging force to the placement unit 33. The first lower case 65 is an example of the first accommodation body that accommodates the second coil spring 64 of which one end in the axial direction is inserted into the first accommodation body. The second lower case 66 is an example of the second accommodation body that accommodates the second coil spring 64 of which the other end in the axial direction is inserted into the second accommodation body. Each of the first lower case 65 and the second lower case 66 is shaped like a closed-end cylinder with one end open and is elongated slightly more compared with each of the first upper case 52 and the second upper case 53.

The first lower case 65 is rotatably attached to a cylindrically shaped second boss 67 in such a manner that the closed-end of the first lower case 65, which is opposite to the open end, is attached by a second screw 68 to the second boss 67 disposed on the back side of the placement unit 33. The second boss 67 and the second screw 68 are longer in length compared with the first boss 54 and the first screw 55. The second lower case 66 is disposed such that a portion of the second lower case 66 overlaps the first lower case 65. In other words, the open end of the first lower case 65 is inserted into the open end of the second lower case 66.

An end of the second coil spring 64 in the axial direction thereof abuts the inside surface of the bottom wall of the first lower case 65, whereas the other end of the second coil spring 64 in the axial direction abuts the inside surface of the bottom wall of the second lower case 66. In this case, the second coil spring 64 is completely covered by the first lower case 65 and the second lower case 66, and in this state, the second coil spring 64 continuously urges the first lower case 65 and the second lower case 66 in directions of separating from each other. Moreover in this case, compared with the first coil spring 51, the second coil spring 64 is slightly longer in the axial direction and the urging force of the second coil spring 64 is larger.

A first lower elongated protrusion 69, which is an example of the first engagement portion, is formed on the outer periphery of the first lower case 65 so as to extend in the urging direction of the second coil spring 64. A second lower groove 70, which is an example of the second engagement portion, is formed on the inner periphery of the second lower case 66 so as to extend in the urging direction of the second coil spring 64 and to be able to receive the first lower elongated protrusion 69.

In the state in which the first lower case 65 is inserted in the second lower case 66 with the first lower elongated protrusion 69 being inserted in the second lower groove 70, the first lower elongated protrusion 69 and the second lower groove 70 are slidable relative to each other in the urging direction of the second coil spring 64, while the first lower elongated protrusion 69 and the second lower groove 70 engage each other in the circumferential direction of the first lower case 65 and the second lower case 66. Accordingly, the first lower case 65 and the second lower case 66 are movable relative to each other in the urging direction of the second coil spring 64 and are rotatable together in the circumferential direction.

As illustrated in FIGS. 6 and 8, a first lower rotating protrusion 71 and a second lower rotating protrusion 72 are disposed on the outer periphery of the first lower case 65 at the end near the placement unit 33 so as to protrude in radial directions. The first lower rotating protrusion 71 and the second lower rotating protrusion 72 are examples of a protrusion. The first lower rotating protrusion 71 and the second lower rotating protrusion 72 are disposed so as to be separated from each other by an acute angle (e.g., 70 degrees) in the circumferential direction and to have a slight distance between each other in the axial direction of the first lower case 65. The first lower rotating protrusion 71 and the second lower rotating protrusion 72 come into contact with the slide member 50, which is moved in conjunction with movement of the edge guides 47. The first lower rotating protrusion 71 and the second lower rotating protrusion 72 thereby cause the first lower case 65 to rotate.

A pair of second restrained plates 73, which are examples of the restrained portion, are disposed on the outer periphery of the second lower case 66 at the end near the placement unit 33 so as to protrude in radial directions. A pair of the second restrained plates 73 are disposed on opposite sides of the second lower case 66 with the central axis of the second lower case 66 interposed therebetween. A pair of the second restrained plates 73 rotate together with the second lower case 66 in conjunction with rotation of the first lower case 65. Note that as illustrated in FIG. 10, a second mortise 74 is provided at the end of the outer periphery of the second lower case 66 near the placement unit 33 in such a manner that the second lower rotating protrusion 72 of the first lower case 65 protrudes out of the second lower case 66 in a radial direction when the second lower case 66 covers the first lower case 65.

As illustrated in FIGS. 6, 7, and 8, a pair of second restraining portions 75 are disposed on the back side of the placement unit 33 at positions straddling the second thrust mechanism 46 in the width direction Y. The second restraining portions 75 are examples of the restraining portion. Each of the second restraining portions 75 is formed as a plate shaped like a letter L and extends in the axial direction of the second coil spring 64. Second restraining surfaces 76 are formed at respective base ends of the second restraining portions 75. Rotation of the second lower case 66 can cause the second restraining surfaces 76 to engage the respective second restrained plates 73 in the axial direction of the second coil spring 64.

Due to the rotation of a pair of the second restrained plates 73 in conjunction with rotation of the second lower case 66, a pair of the second restrained plates 73 engage respective second restraining surfaces 76 of a pair of the second restraining portions 75 in the axial direction of the second coil spring 64. As a result, the urging force of the second coil spring 64 restrains the first lower case 65 and the second lower case 66 from moving relative to each other in the axial direction of the second coil spring 64. In other words, the second restrained plates 73 rotate together with the second lower case 66 in conjunction with rotation of the first lower case 65, and thereby the second restrained plates 73 are displaced to a first position (a position illustrated in FIG. 12) at which the second restrained plates 73 are restrained by the second restraining portions 75 and to a second position (a position illustrated in FIG. 10) at which the second restrained plates 73 are not restrained by the second restraining portions 75.

Figure 9:
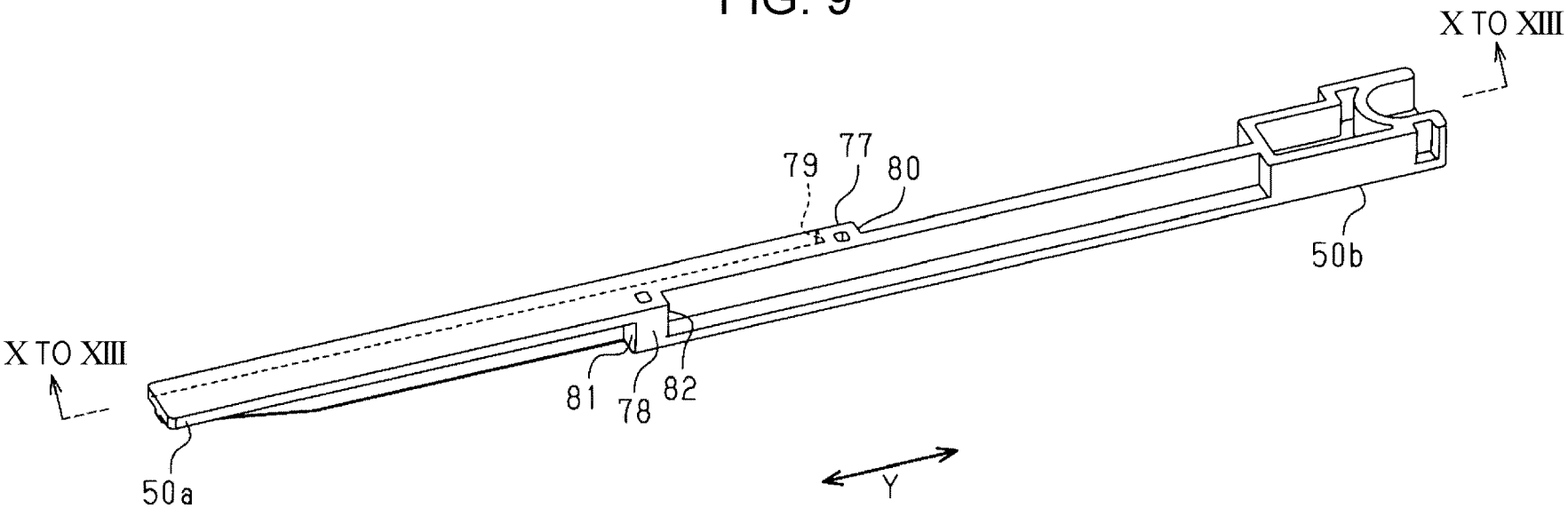
FIG. 9 is a perspective view illustrating a slide member.

As illustrated in FIGS. 8 and 9, the slide member 50 has an upper projection 77 that is shaped like a block and disposed on the top side of the slide member 50 in an intermediate portion in the width direction Y. The slide member 50 also has a lower projection 78 that is shaped like a block and disposed on the bottom side thereof in an intermediate portion in the width direction Y. The upper projection 77 and the lower projection 78 are disposed with a spacing therebetween in the width direction Y. In other words, the upper projection 77 is disposed at a position closer to the base end 50*b* of the slide member 50 than the lower projection 78, whereas the lower projection 78 is disposed at a position closer to the leading end 50*a* of the slide member 50 than the upper projection 77.

Each of the upper projection 77 and the lower projection 78 has two side surfaces opposite to each other in the width direction Y. A side surface of the upper projection 77 near the leading end 50*a* is denoted by a first upper face 79, whereas the other side surface of the upper projection 77 near the base end 50*b* is denoted by a second upper face 80. A side surface of the lower projection 78 near the leading end 50*a* is denoted by a first lower face 81, whereas the other side surface of the lower projection 78 near the base end 50*b* is denoted by a second lower face 82.

As illustrated in FIGS. 4 and 8, when the slide member 50 moves in conjunction with movement of a pair of the edge guides 47 from positions that are furthest away from each other to positions that are closest to each other, the first lower face 81 is first brought into contact with the first lower rotating protrusion 71, which causes the first lower rotating protrusion 71 to rotate. Subsequently, the first upper face 79 is brought into contact with the first upper rotating protrusion 58, which causes the first upper rotating protrusion 58 to rotate.

On the other hand, when the slide member 50 moves in conjunction with movement of a pair of the edge guides 47 from positions that are closest to each other to positions that are furthest away from each other, the second upper face 80 is first brought into contact with the second upper rotating protrusion 59, which causes the second upper rotating protrusion 59 to rotate. Subsequently, the second lower face 82 is brought into contact with the second lower rotating protrusion 72, which causes the second lower rotating protrusion 72 to rotate.

As illustrated in FIGS. 2 and 6, an abutment plate 83 is fixed in the housing 38 at a position opposing the first thrust mechanism 45 and the second thrust mechanism 46 in the depth direction X. A first projection 84 that is shaped like a hemisphere is disposed at a center portion on the outside surface of the bottom wall of the second upper case 53 of the first thrust mechanism 45. A second projection 85 that is shaped like a hemisphere is disposed at a center portion on the outside surface of the bottom wall of the second lower case 66 of the second thrust mechanism 46.

Figure 21:
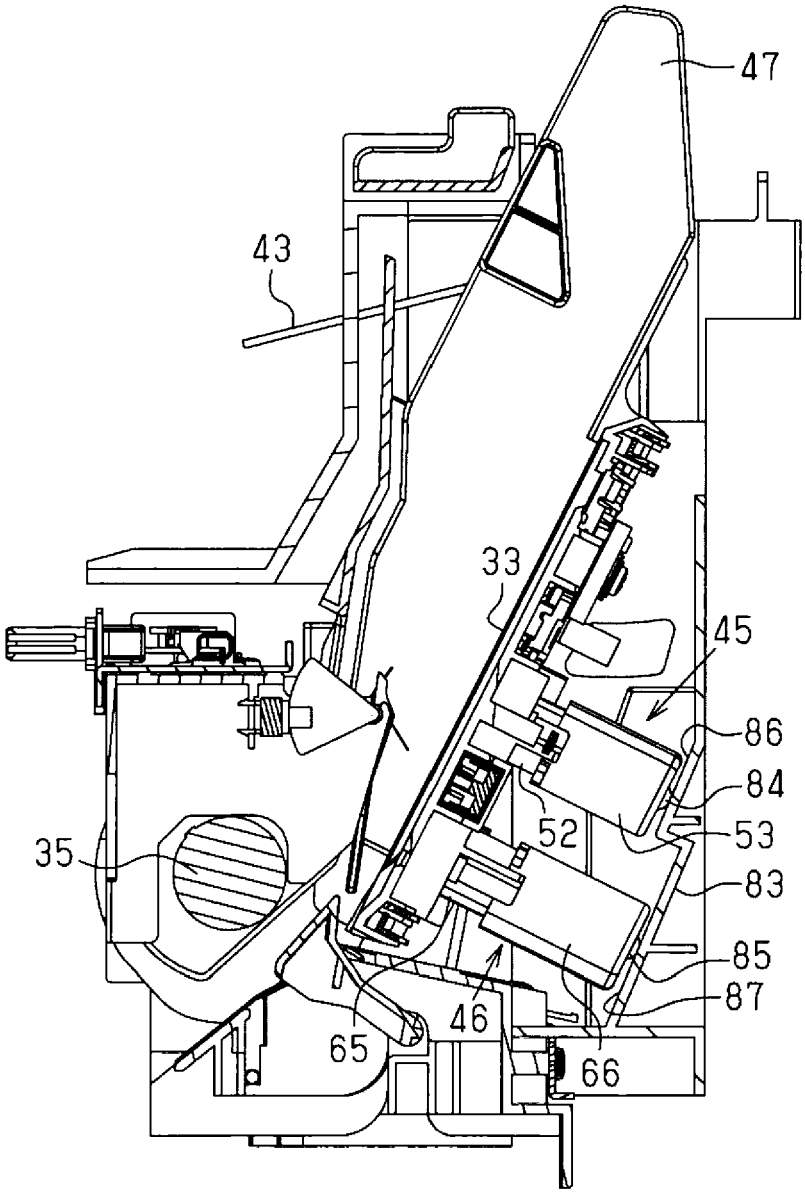
FIG. 21 is a cross-sectional view illustrating a state in which thirty large-size sheets of paper are placed on the placement unit.

As illustrated in FIGS. 6 and 21, the abutment plate 83 includes a first abutment surface 86 and a second abutment surface 87, both of which are examples of an abutment portion and are formed as flat surfaces. When the first coil spring 51 imparts an urging force to the placement unit 33, the first projection 84 of the second upper case 53 abuts the first abutment surface 86. When the second coil spring 64 imparts an urging force to the placement unit 33, the second projection 85 of the second lower case 66 abuts the second abutment surface 87. In this case, the first projection 84, which is shaped like a hemisphere, is a portion of the second upper case 53 that comes into contact with the first abutment surface 86. The second projection 85, which is shaped like a hemisphere, is a portion of the second lower case 66 that comes into contact with the second abutment surface 87.

Next, operation of the first thrust mechanism 45 will be described with reference to FIGS. 10 to 13. Note that the slide member 50 illustrated in FIGS. 10 to 13 are cross sections that are cut along line X,XI,XII,XIII-X,XI,XII,XIII in FIG. 9. As illustrated in FIG. 10, in the state in which a pair of the first restrained plates 60 of the second upper case 53 of the first thrust mechanism 45 do not engage respective first restraining surfaces 63 of a pair of the first restraining portions 62 in the axial direction of the first coil spring 51, movement of the first upper case 52 and the second upper case 53 relative to each other in the axial direction of the first coil spring 51 is not restrained by the urging force of the first coil spring 51. As a result, the urging force of the first coil spring 51 acts on the placement unit 33 due to the first projection 84 of the second upper case 53 abutting the first abutment surface 86. In this case, the first upper rotating protrusion 58 stays at a position at which the first upper rotating protrusion 58 is ready to come into contact with the slide member 50, whereas the second upper rotating protrusion 59 stays at a position away from the moving path of the slide member 50.

Figure 11:
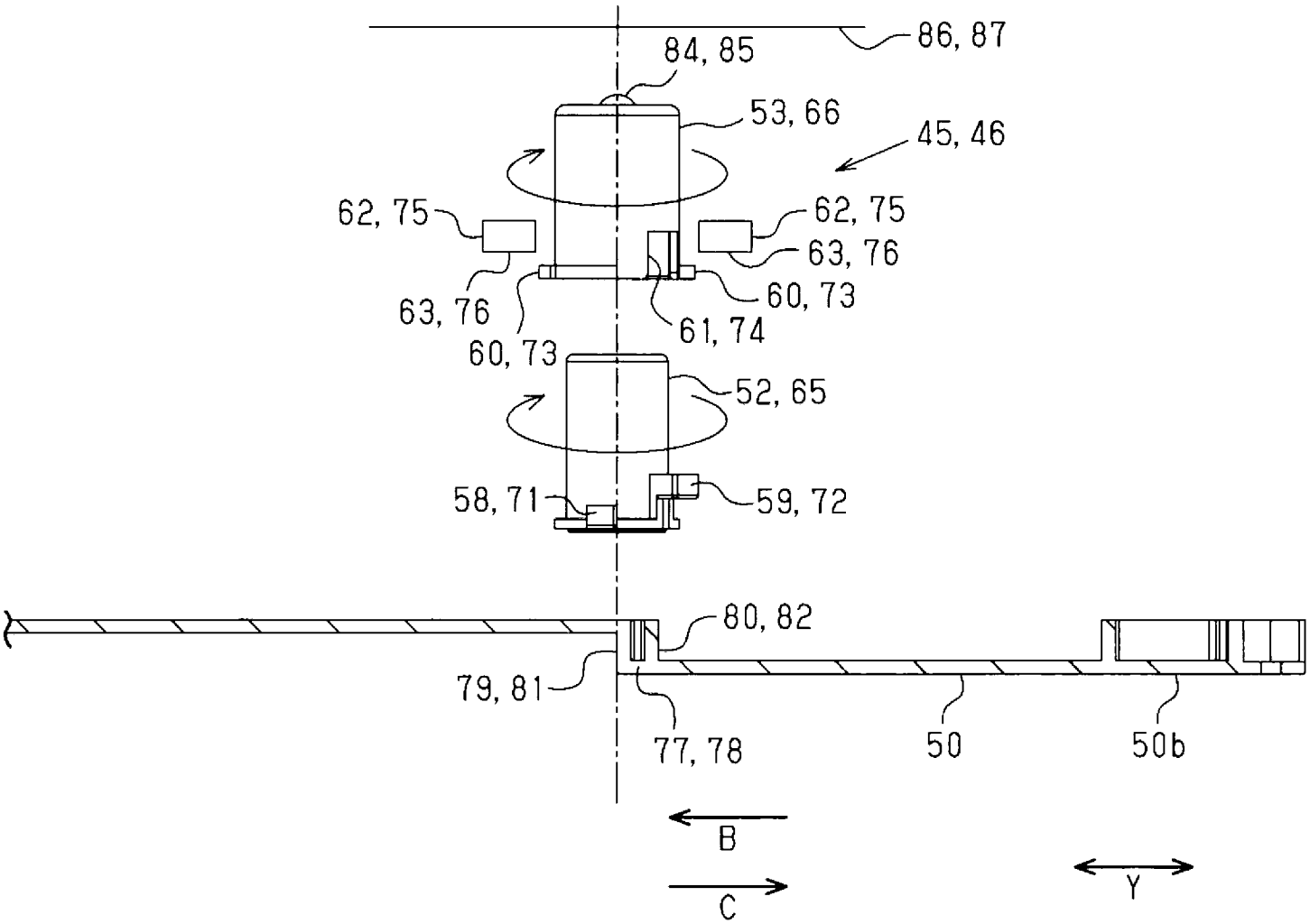
FIG. 11 is a schematic diagram illustrating actions of the first thrust mechanism, the second thrust mechanism, and the slide member.

Subsequently, if a pair of the edge guides 47 are moved in the direction to be closer to each other, the slide member 50 is caused to move in a first direction B that is parallel to the width direction Y. As a result, as illustrated in FIG. 11, the first upper face 79 of the upper projection 77 of the slide member 50 comes into contact with the first upper rotating protrusion 58 of the first upper case 52. Further movement of the edge guides 47 in the direction of moving closer to each other causes the slide member 50 to move further in the first direction B.

Figure 12:
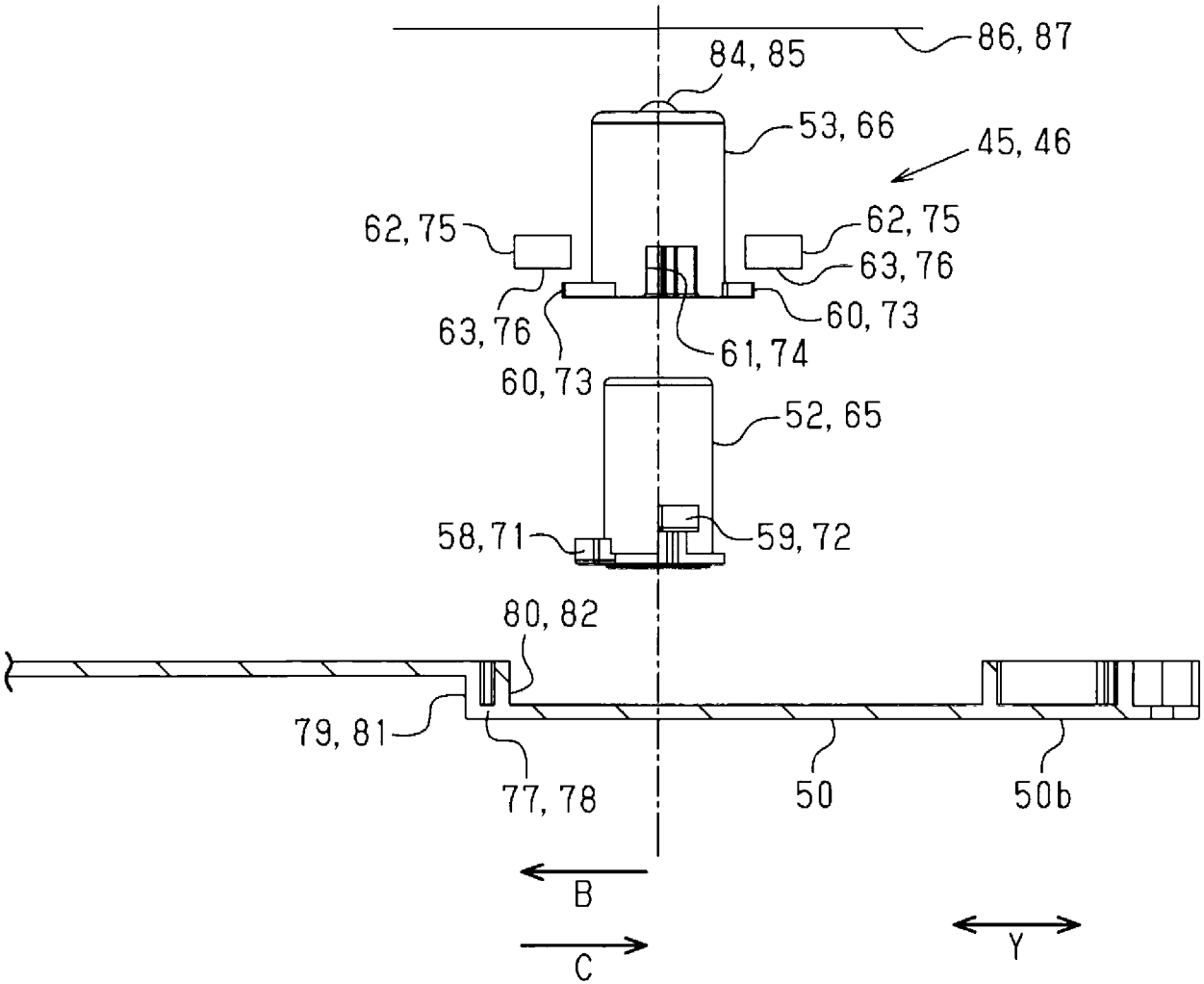
FIG. 12 is a schematic diagram illustrating actions of the first thrust mechanism, the second thrust mechanism, and the slide member.

As a result, as illustrated in FIG. 12, the first upper rotating protrusion 58, the first upper case 52, and the second upper case 53 rotate together in a forward direction. A pair of the first restrained plates 60 of the second upper case 53 are thereby rotated to the position at which the first restrained plates 60 engage the respective first restraining surfaces 63 of a pair of the first restraining portions 62 in the axial direction of the first coil spring 51. The relative movement of the first upper case 52 and the second upper case 53 in the axial direction of the first coil spring 51 is thereby restrained due to the urging force of the first coil spring 51.

As a result, the urging force of the first coil spring 51 does not act on the placement unit 33 irrespective of whether the first projection 84 of the second upper case 53 abuts the first abutment surface 86 or not. In this case, the first upper rotating protrusion 58 is rotated to a position away from the moving path of the slide member 50, whereas the second upper rotating protrusion 59 is rotated to a position at which the second upper rotating protrusion 59 is ready to come into contact with the slide member 50.

Figure 13:
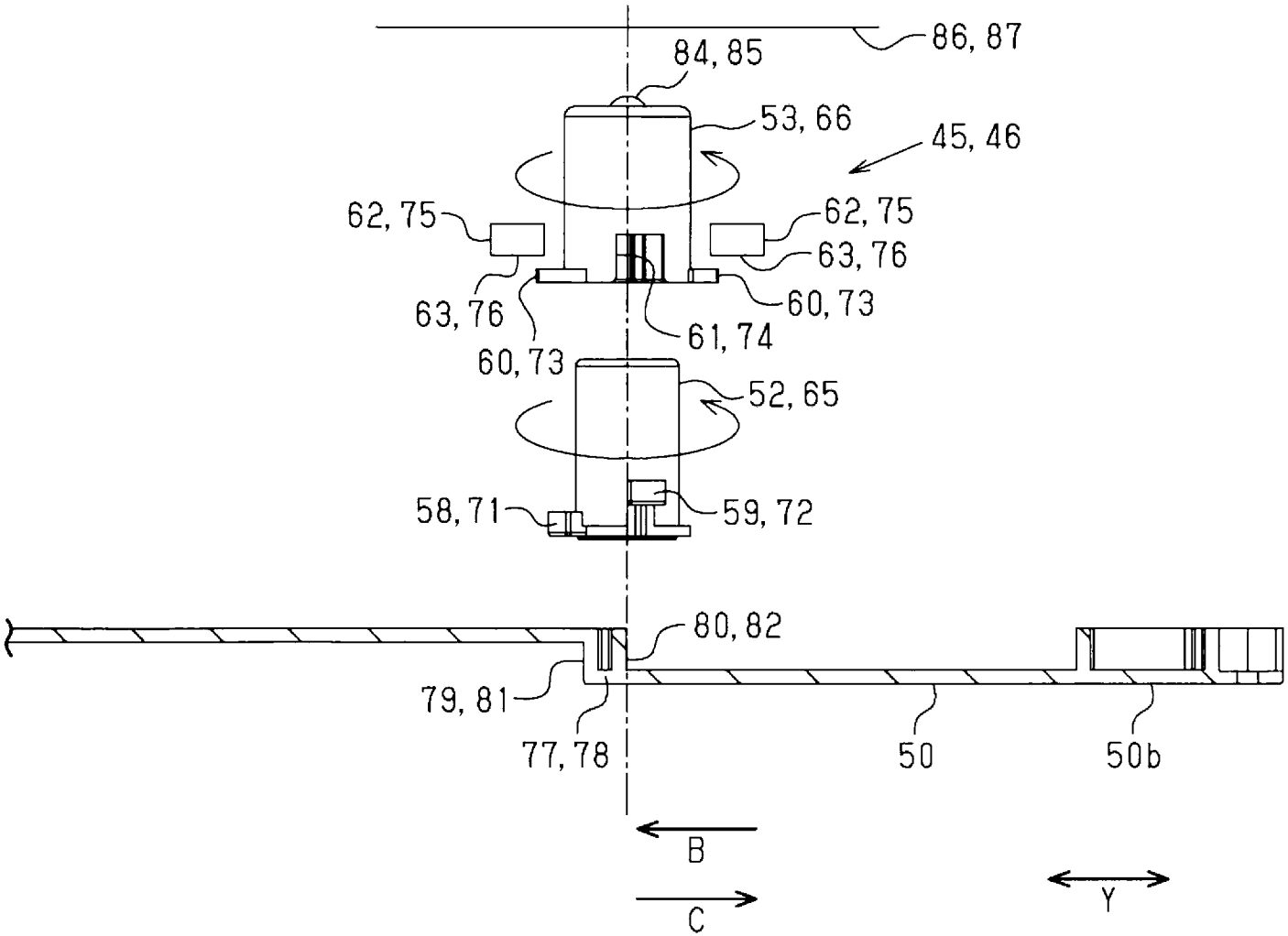
FIG. 13 is a schematic diagram illustrating actions of the first thrust mechanism, the second thrust mechanism, and the slide member.

Subsequently, if a pair of the edge guides 47 are moved in the direction away from each other, the slide member 50 is caused to move in a second direction C that is opposite to the first direction B. As a result, as illustrated in FIG. 13, the second upper face 80 of the upper projection 77 of the slide member 50 comes into contact with the second upper rotating protrusion 59 of the first upper case 52. Further movement of a pair of the edge guides 47 in the direction of moving away from each other causes the slide member 50 to move further in the second direction C.

As a result, as illustrated in FIG. 10, the second upper rotating protrusion 59, the first upper case 52, and the second upper case 53 rotate together in a backward direction that is opposite to the forward direction. A pair of the first restrained plates 60 of the second upper case 53 are thereby rotated to positions of not engaging the first restraining surfaces 63 of a pair of the first restraining portions 62 in the axial direction of the first coil spring 51. As a result, the relative movement of the first upper case 52 and the second upper case 53 in the axial direction of the first coil spring 51 is not restrained by the urging force of the first coil spring 51.

Accordingly, the first projection 84 of the second upper case 53 abuts the first abutment surface 86, and thereby the urging force of the first coil spring 51 acts on the placement unit 33. In this case, the first upper rotating protrusion 58 stays at a position at which the first upper rotating protrusion 58 is ready to come into contact with the slide member 50, whereas the second upper rotating protrusion 59 stays at a position away from the moving path of the slide member 50.

Note that operation of the second thrust mechanism 46 is the same as the operation of the first thrust mechanism 45 described above, and thus a repetitive description will be omitted. In other words, the description of operation of the second thrust mechanism 46 will be such that on the basis of the description of operation of the first thrust mechanism 45, reference numerals of the members will be merely replaced with those provided in brackets in FIGS. 10 to 13.

Figure 14:
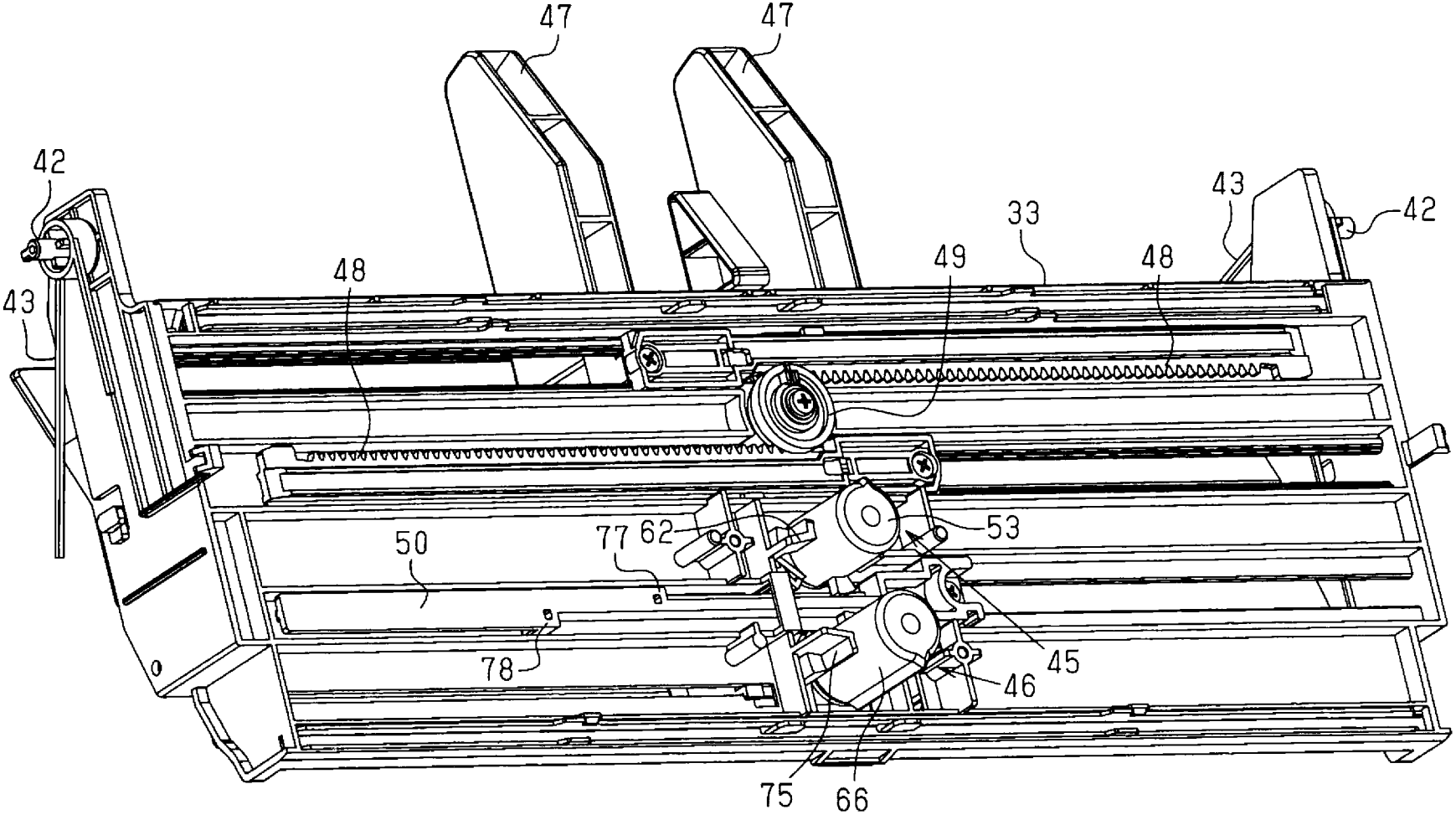
FIG. 14 is a schematic diagram illustrating actions of the first thrust mechanism, the second thrust mechanism, the slide member, and edge guides.

Next, operation of the first thrust mechanism 45 and the second thrust mechanism 46 will be described in the case in which a pair of the edge guides 47 are moved from positions that are closest to each other to positions that are furthest away from each other. As illustrated in FIGS. 6, 8, and 14, when a pair of the edge guides 47 are closest to each other, the first restrained plates 60 of the second upper case 53 engage the first restraining portions 62 in the axial direction of the second upper case 53, which restrains the second upper case 53 from moving in the axial direction thereof. As a result, the urging force of the first coil spring 51 does not act on the placement unit 33. In other words, a push-up force by the first thrust mechanism 45 does not act on the placement unit 33.

Similarly, the second restrained plates 73 of the second lower case 66 engage the second restraining portions 75 in the axial direction of the second lower case 66, which restrains the second lower case 66 from moving in the axial direction thereof. As a result, the urging force of the second coil spring 64 does not act on the placement unit 33. In other words, a push-up force by the second thrust mechanism 46 does not act on the placement unit 33.

Figure 15:
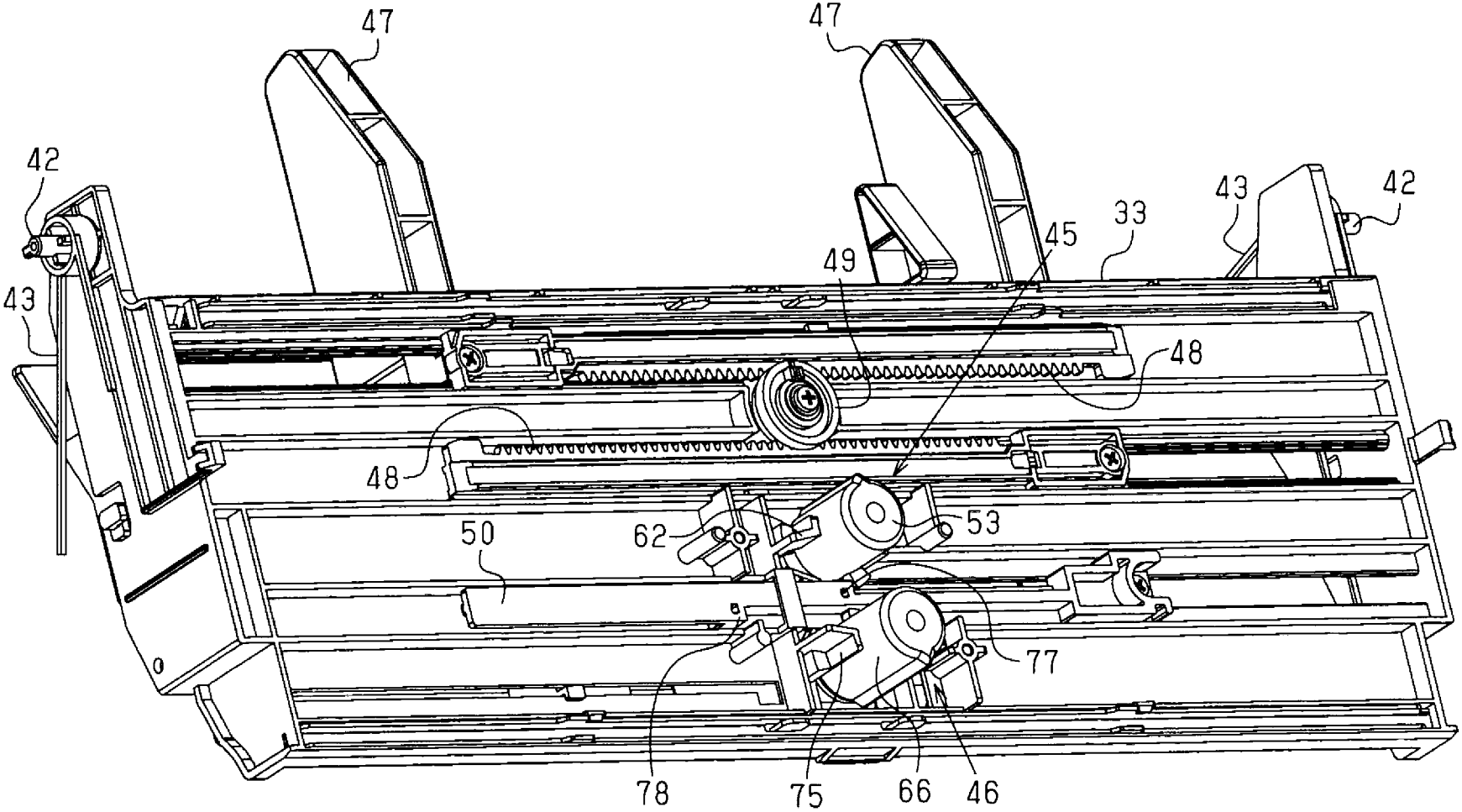
FIG. 15 is a schematic diagram illustrating actions of the first thrust mechanism, the second thrust mechanism, the slide member, and the edge guides.

As illustrated FIGS. 8 and 15, movement of the edge guides 47 in the direction away from each other causes the second upper face 80 of the slide member 50 to abut the second upper rotating protrusion 59 and to start rotating the first restrained plates 60 together with the second upper rotating protrusion 59. The first restrained plates 60 are caused to rotate counterclockwise when viewed from behind the placement unit 33.

Figure 16:
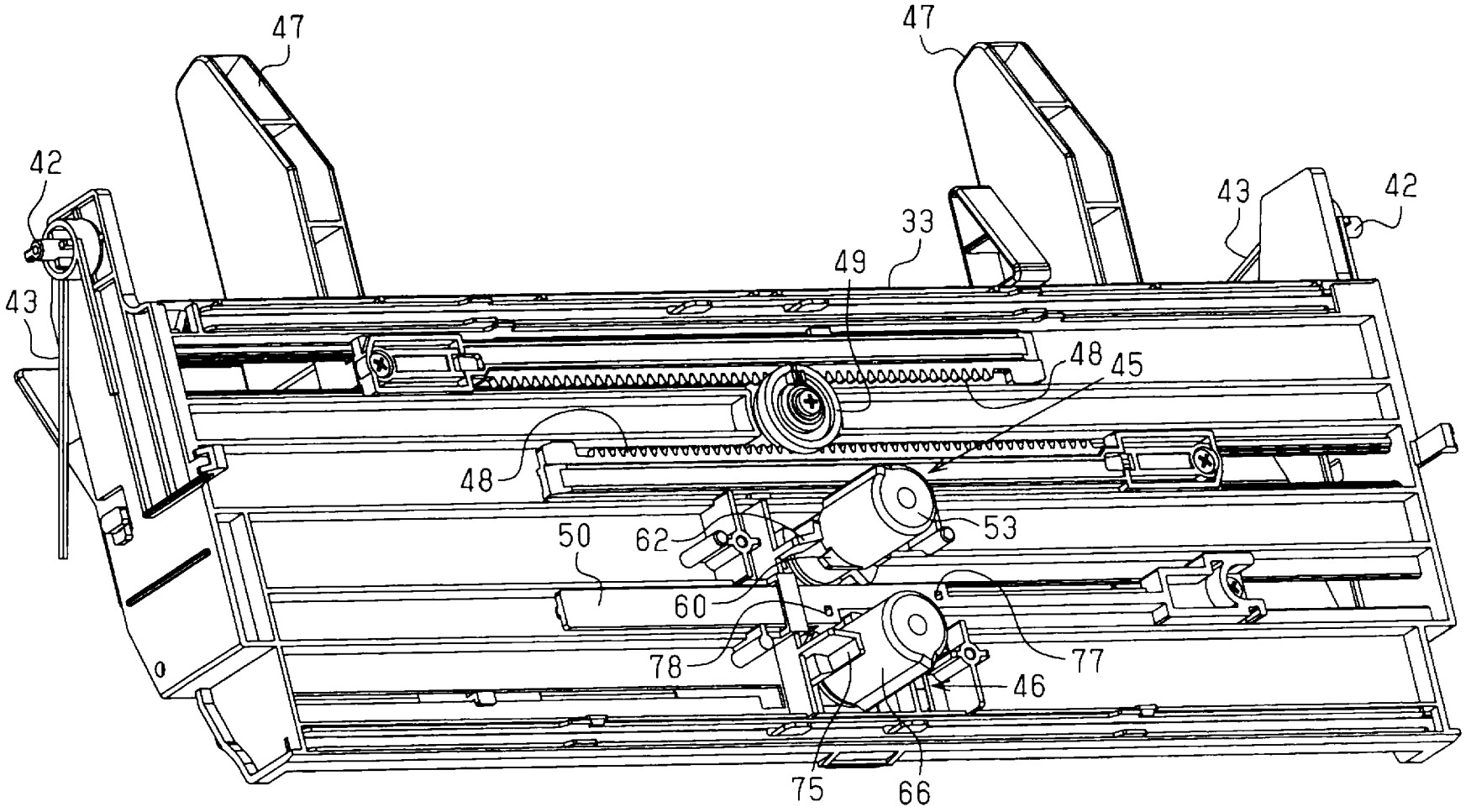
FIG. 16 is a schematic diagram illustrating actions of the first thrust mechanism, the second thrust mechanism, the slide member, and the edge guides.

As illustrated in FIGS. 8 and 16, further movement of the edge guides 47 in the direction away from each other causes the first restrained plates 60 to rotate counterclockwise together with the second upper rotating protrusion 59 when viewed from behind the placement unit 33. Consequently, the state of engagement between the first restrained plates 60 and the first restraining portions 62 in the axial direction of the second upper case 53 is terminated.

As a result, the urging force of the first coil spring 51 urges the second upper case 53 toward the first abutment surface 86, which causes the first projection 84 of the second upper case 53 to abut the first abutment surface 86. The urging force of the first coil spring 51 thereby acts on the placement unit 33. In other words, the push-up force by the first thrust mechanism 45 acts on the placement unit 33.

In this case, the placement unit 33 and the sheets P placed thereon are pushed up toward the feed roller 35 by the push-up force of the first thrust mechanism 45. In this state, even if a pair of the edge guides 47 are moved in the direction away from each other, the first thrust mechanism 45 is not brought into contact with the slide member 50. A pair of the edge guides 47 are thereby permitted to move in the direction away from each other.

On the other hand, in the state in which the placement unit 33 and the sheets P placed thereon are pushed up toward the feed roller 35 by the push-up force of the first thrust mechanism 45, if a pair of the edge guides 47 are made to move in the direction closer to each other, the first upper face 79 of the slide member 50 abuts the first upper rotating protrusion 58. As a result, the first restrained plates 60 are made to rotate clockwise together with the first upper rotating protrusion 58 when viewed from behind the placement unit 33.

In this case, however, the first restrained plates 60 engage the first restraining portions 62 in this rotation direction (i.e., clockwise when viewed from behind the placement unit 33), and the first restraining portions 62 restrain the first restrained plates 60 from rotating further in this rotation direction. A pair of the edge guides 47 are thereby restrained from moving in the direction closer to each other.

Figure 17:
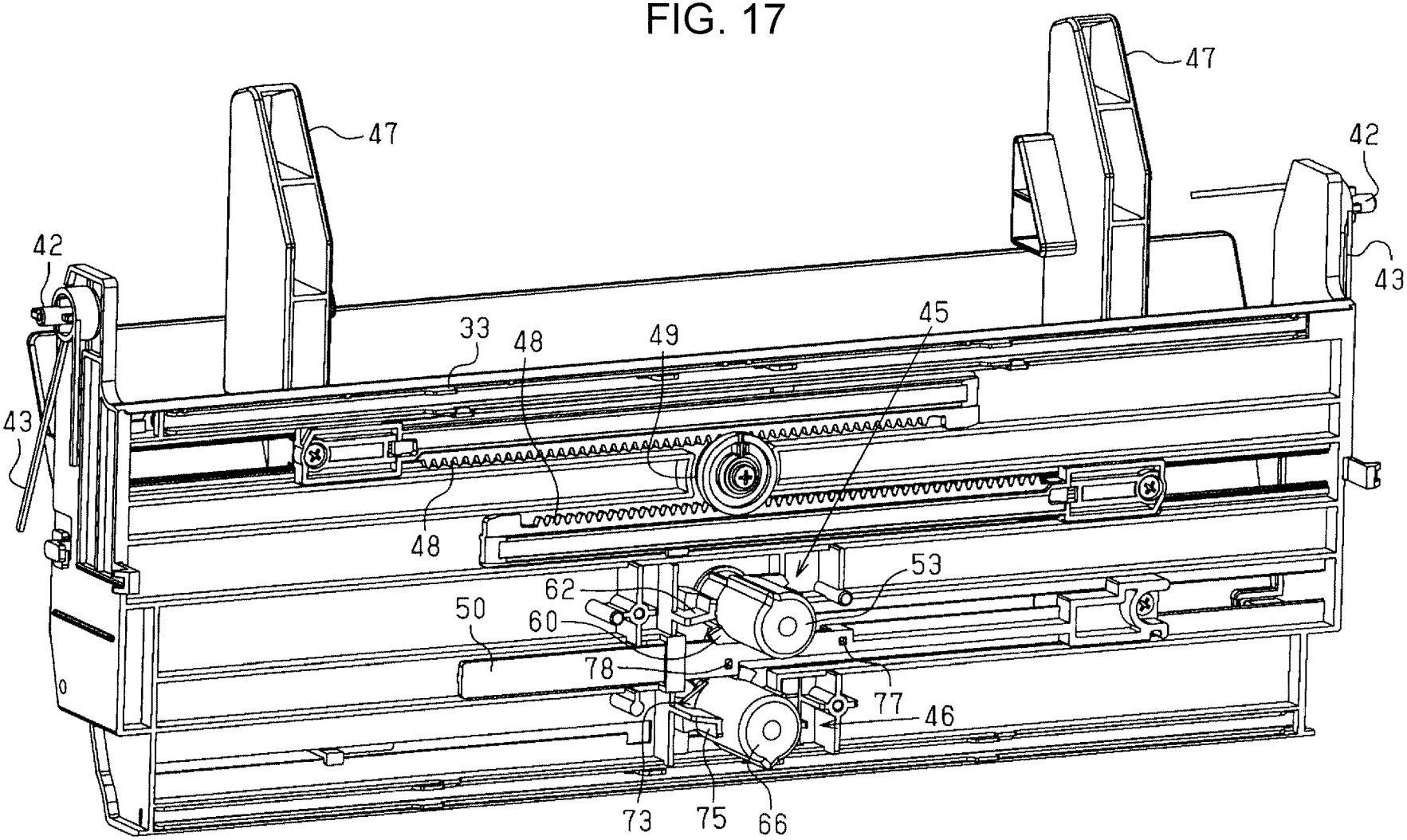
FIG. 17 is a schematic diagram illustrating actions of the first thrust mechanism, the second thrust mechanism, the slide member, and the edge guides.

Subsequently, movement of the edge guides 47 in the direction further away from each other, as illustrated FIGS. 8 and 17, causes the second lower face 82 of the slide member 50 to abut the second lower rotating protrusion 72 and to start rotating the second restrained plates 73 together with the second lower rotating protrusion 72. The second restrained plates 73 are caused to rotate clockwise, when viewed from behind the placement unit 33.

Figure 18:
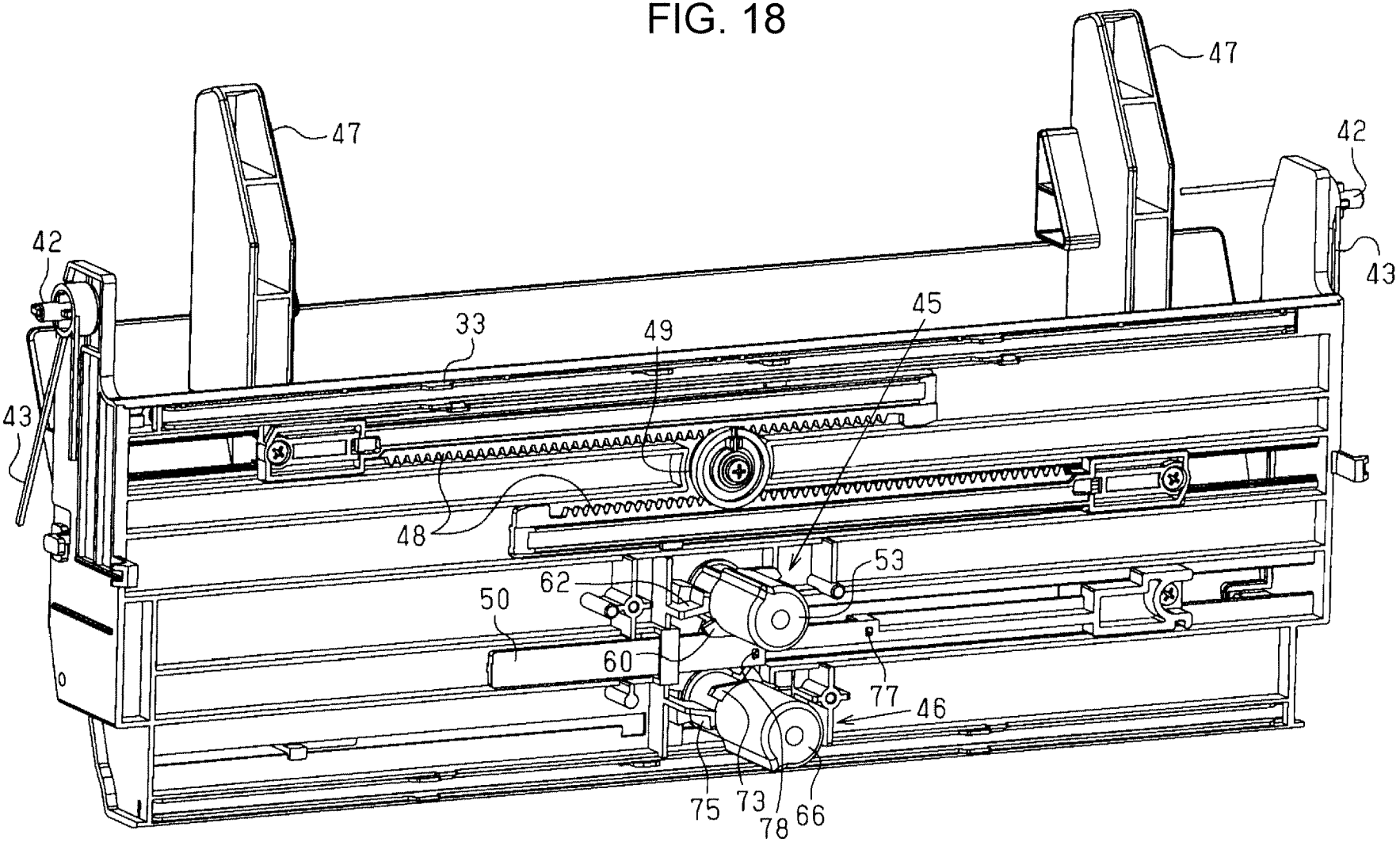
FIG. 18 is a schematic diagram illustrating actions of the first thrust mechanism, the second thrust mechanism, the slide member, and the edge guides.

Further movement of the edge guides 47 in the direction away from each other, as illustrated in FIGS. 8 and 18, causes the second restrained plates 73 to rotate clockwise together with the second lower rotating protrusion 72 when viewed from behind the placement unit 33. Consequently, the state of engagement between the second restrained plates 73 and the second restraining portions 75 in the axial direction of the second lower case 66 is terminated.

As a result, the urging force of the second coil spring 64 urges the second lower case 66 toward the second abutment surface 87, which causes the second projection 85 of the second lower case 66 to abut the second abutment surface 87. The urging force of the second coil spring 64 thereby acts on the placement unit 33. In other words, a push-up force by the second thrust mechanism 46 acts on the placement unit 33.

In this case, the placement unit 33 and the sheets P placed thereon are pushed up toward the feed roller 35 by the push-up force of the second thrust mechanism 46. In this state, even if a pair of the edge guides 47 are moved in the direction away from each other, the second thrust mechanism 46 is not brought into contact with the slide member 50. A pair of the edge guides 47 are thereby permitted to move in the direction away from each other.

On the other hand, in the state in which the placement unit 33 and the sheets P placed thereon are pushed up toward the feed roller 35 by the push-up force of the second thrust mechanism 46, if a pair of the edge guides 47 are made to move in the direction closer to each other, the first lower face 81 of the slide member 50 abuts the first lower rotating protrusion 71. As a result, the second restrained plates 73 are made to rotate counterclockwise together with the first lower rotating protrusion 71 when viewed from behind the placement unit 33.

Figure 19:
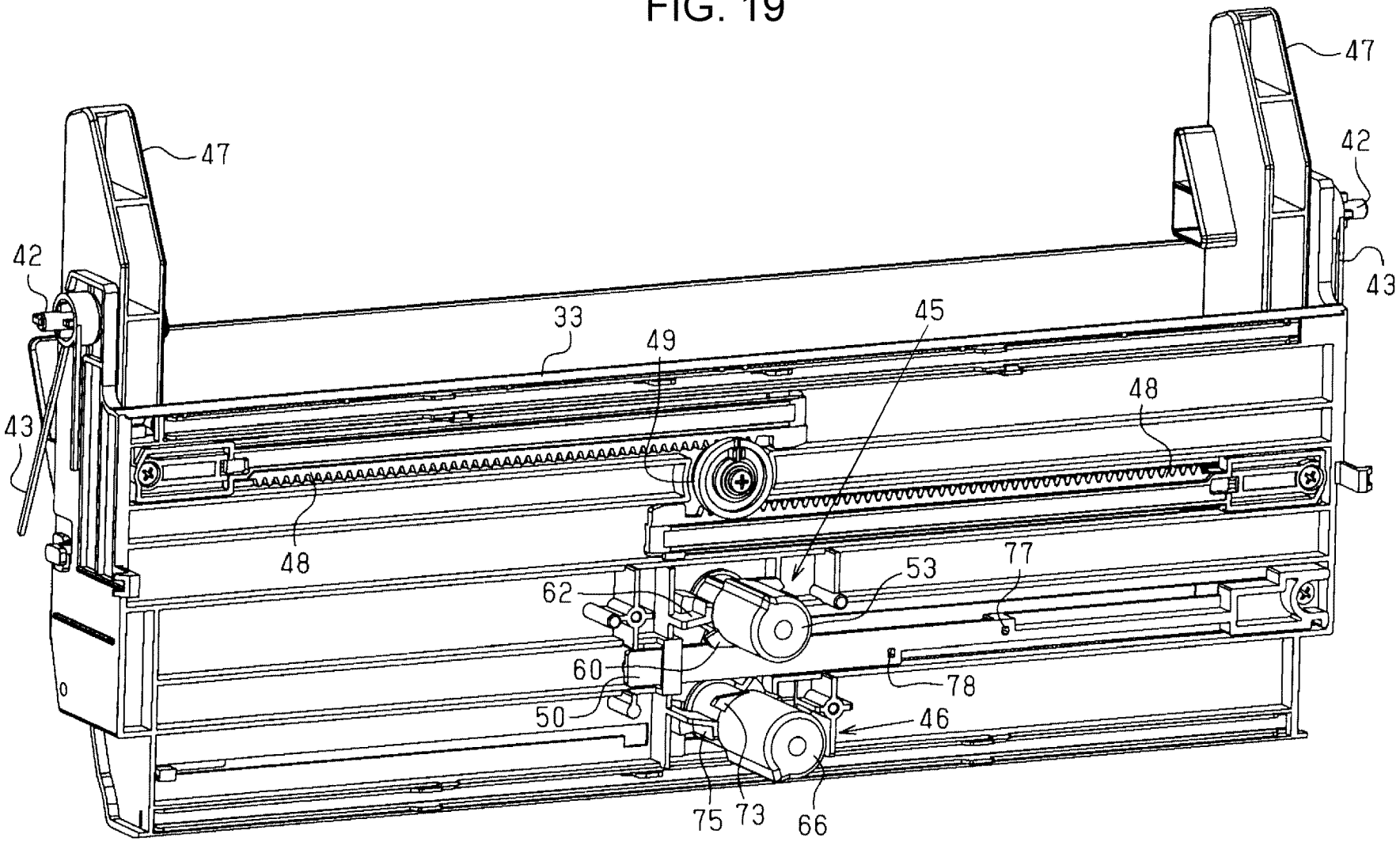
FIG. 19 is a schematic diagram illustrating actions of the first thrust mechanism, the second thrust mechanism, the slide member, and the edge guides.

In this case, however, the second restrained plates 73 engage the second restraining portions 75 in this rotation direction (i.e., counterclockwise when viewed from behind the placement unit 33), and the second restraining portions 75 restrain the second restrained plates 73 from rotating further in this rotation direction. A pair of the edge guides 47 are thereby restrained from moving in the direction closer to each other. Subsequently, as illustrated in FIG. 19, further movement of a pair of the edge guides 47 in the direction away from each other causes a pair of the edge guides 47 to move to positions that are furthest away from each other.

When a pair of the edge guides 47 are moved from positions that are furthest away from each other to positions that are closest to each other, operation of the first thrust mechanism 45 and the second thrust mechanism 46 will be the reverse of the above described operation of the first thrust mechanism 45 and the second thrust mechanism 46 when a pair of the edge guides 47 are moved from the positions that are closest to each other to the positions that are furthest away from each other.

In the case in which a pair of the edge guides 47 are moved from the positions that are furthest away from each other to the positions that are closer to each other, the second thrust mechanism 46 restrains the urging force of the second coil spring 64 from acting on the placement unit 33 before the first thrust mechanism 45 restrains the urging force of the first coil spring 51 from acting on the placement unit 33.

Figure 25:
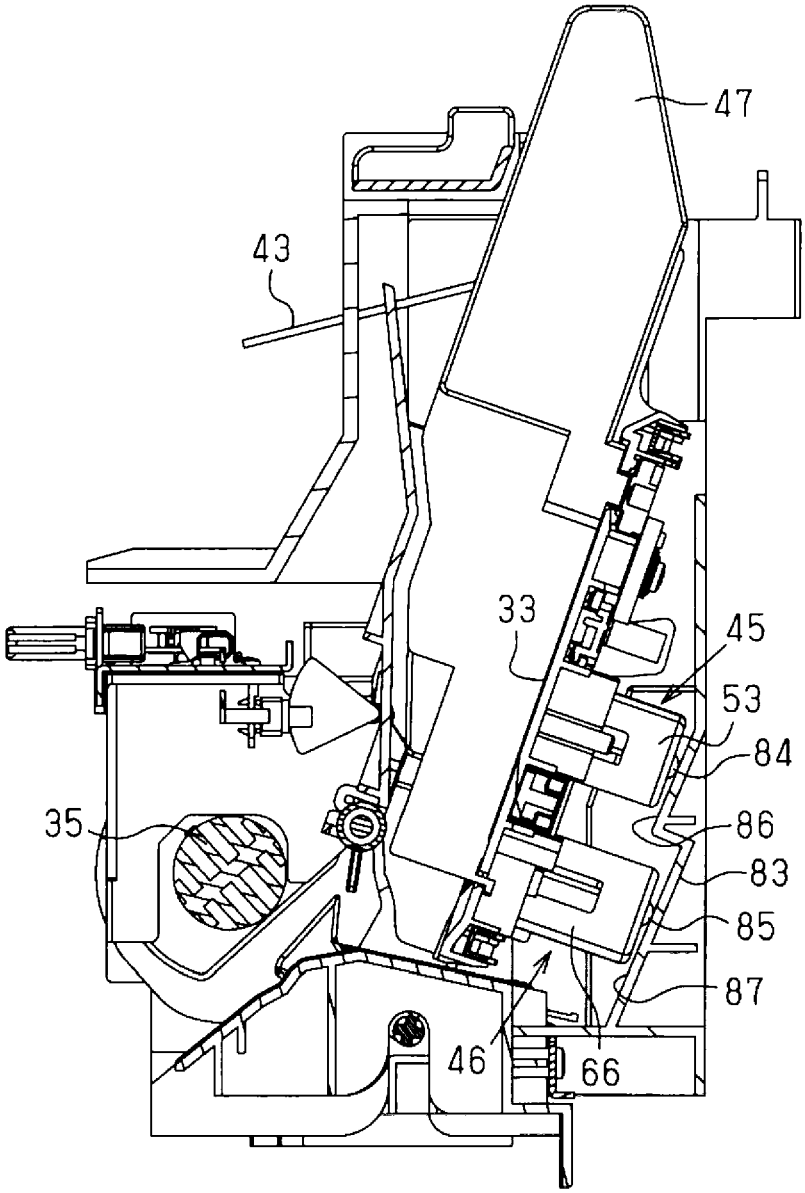
FIG. 25 is a cross-sectional view illustrating a state in which the placement unit is at a standby position.

Note that when the placement unit 33 is at the standby position, a pair of the edge guides 47 move from the positions that are furthest away from each other to the positions that are closest to each other. As illustrated in FIG. 25, when the placement unit 33 is at the standby position, the first thrust mechanism 45 and the second thrust mechanism 46 are compressed by the abutment plate 83 against respective urging forces of the first coil spring 51 and the second coil spring 64. In this state, the second upper case 53 of the first thrust mechanism 45 and the second lower case 66 of the second thrust mechanism 46 are maintained so as to be able to rotate freely.

As described above, in the present embodiment, the slide member 50 moves in conjunction with the movement of the edge guides 47 when the edge guides 47 are adjusted so as to fit the width of sheets P. In this process, the slide member 50 comes into contact with the first thrust mechanism 45 and with the second thrust mechanism 46 successively. In accordance with the position to which the slide member 50 has been moved, the first thrust mechanism 45 and the second thrust mechanism 46 selectively restrain the urging forces of the first coil spring 51 and the second coil spring 64 from acting on the placement unit 33.

In other words, due to the slide member 50 coming into contact with the first thrust mechanism 45, the first restrained plates 60 are caused to rotate to a first position at which the first restrained plates 60 engage the first restraining portions 62 in the axial direction of the second upper case 53. As a result, the second upper case 53 is restrained from moving relative to the first upper case 52, and the urging force of the first coil spring 51 is thereby restrained from acting on the placement unit 33.

On the other hand, due to the slide member 50 coming into contact with the second thrust mechanism 46, the second restrained plates 73 are caused to rotate to the first position at which the second restrained plates 73 engage the second restraining portions 75 in the axial direction of the second lower case 66. As a result, the second lower case 66 is restrained from moving relative to the first lower case 65, and the urging force of the second coil spring 64 is restrained from acting on the placement unit 33.

When sheets P are placed on the placement unit 33, a change in the length of the sheets P in the width direction Y affects the total weight of the sheets P. Accordingly, in a case in which the urging forces of only a pair of the torsion coil springs 43 urges the placement unit 33 and the sheets P placed thereon toward the feed roller 35, the urging force may not be sufficient to provide the sheets P with an appropriate contact pressure against the feed roller 35. Insufficient contact pressure of the sheets P against the feed roller 35 may lead to a problem that the feed roller 35 does not feed the sheets P properly.

According to the present embodiment, however, the first thrust mechanism 45 and the second thrust mechanism 46 can selectively impart the urging forces of the first coil spring 51 and the second coil spring 64 to the placement unit 33 in accordance with the distance between a pair of the edge guides 47 that corresponds to the length (in the width direction Y) of the sheets P placed on the placement unit 33.

More specifically, when the size of sheets P placed on the placement unit 33 is large, the urging forces of a pair of the torsion coil springs 43 are backed by both of the urging forces of the first coil spring 51 of the first thrust mechanism 45 and the second coil spring 64 of the second thrust mechanism 46. When the size of sheets P placed on the placement unit 33 is medium, the urging forces of a pair of the torsion coil springs 43 are backed only by the urging force of the first coil spring 51 of the first thrust mechanism 45. When the size of sheets P placed on the placement unit 33 is small, the urging forces of a pair of the torsion coil springs 43 are not backed by the urging forces of the first coil spring 51 of the first thrust mechanism 45 and the second coil spring 64 of the second thrust mechanism 46.

With this configuration, according to the present embodiment, even if the size of the sheets P placed on the placement unit 33 changes, the contact pressure of the sheets P against the feed roller 35 can be maintained appropriately simply by adjusting the distance between a pair of the edge guides 47 so as to fit the width of the sheets P. Excessively high contact pressure of the sheets P against the feed roller 35 may lead to a problem that for example, the feed roller 35 feeds two or more sheets P at a time in an overlapped state.

Figure 20:
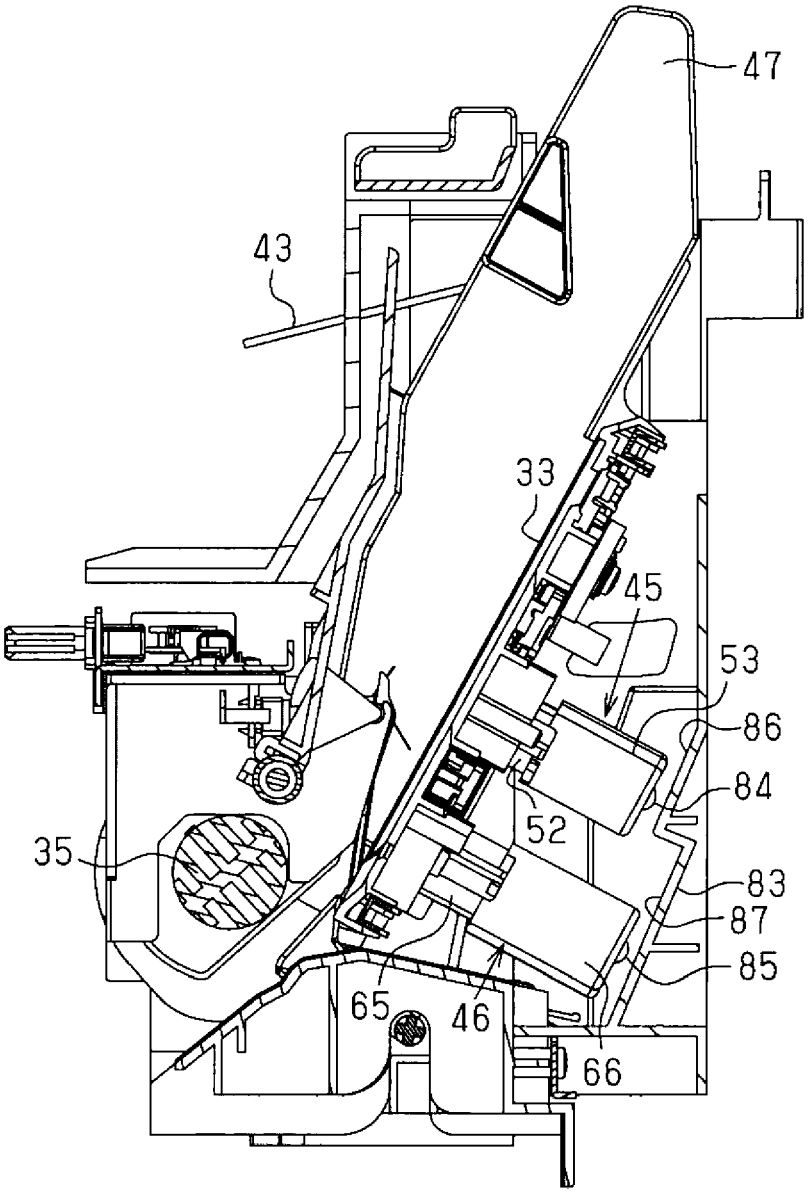
FIG. 20 is a cross-sectional view illustrating a state in which fifteen or less large-size sheets of paper are placed on the placement unit.

Moreover in the present embodiment, as illustrated in FIG. 20, if the number of the sheets P placed on the placement unit 33 is less than or equal to a predetermined number, the placement unit 33 is configured to be pushed up only by the urging forces of the torsion coil springs 43 even if the size of the sheets P is large. With this configuration, the first thrust mechanism 45 and the second thrust mechanism 46 are separated from the abutment plate 83 even though they are in operation, and the push-up forces of the first thrust mechanism 45 and the second thrust mechanism 46 stop acting on the placement unit 33.

More specifically, in a case of large size sheets P of a basis weight of 80 g/m$^2$ being placed on the placement unit 33, when the number of sheets P placed thereon becomes fifteen or less, the first thrust mechanism 45 and the second thrust mechanism 46 are configured to be separated from the abutment plate 83 even when they are in operation. This configuration is adopted because even if the size of the sheets P placed on the placement unit 33 are large, the total weight of the sheets P decreases as the number of the sheets P decreases, and when the number of the sheets P on the placement unit 33 becomes small, the contact pressure of the sheets P against the feed roller 35 becomes excessively high.

For example, as illustrated in FIG. 21, in a case in which thirty large size sheets P of a basis weight of 80 g/m$^2$ are placed on the placement unit 33, the first thrust mechanism 45 and the second thrust mechanism 46 in operation abut the abutment plate 83, and the respective push-up forces act on the placement unit 33.

Figure 22:
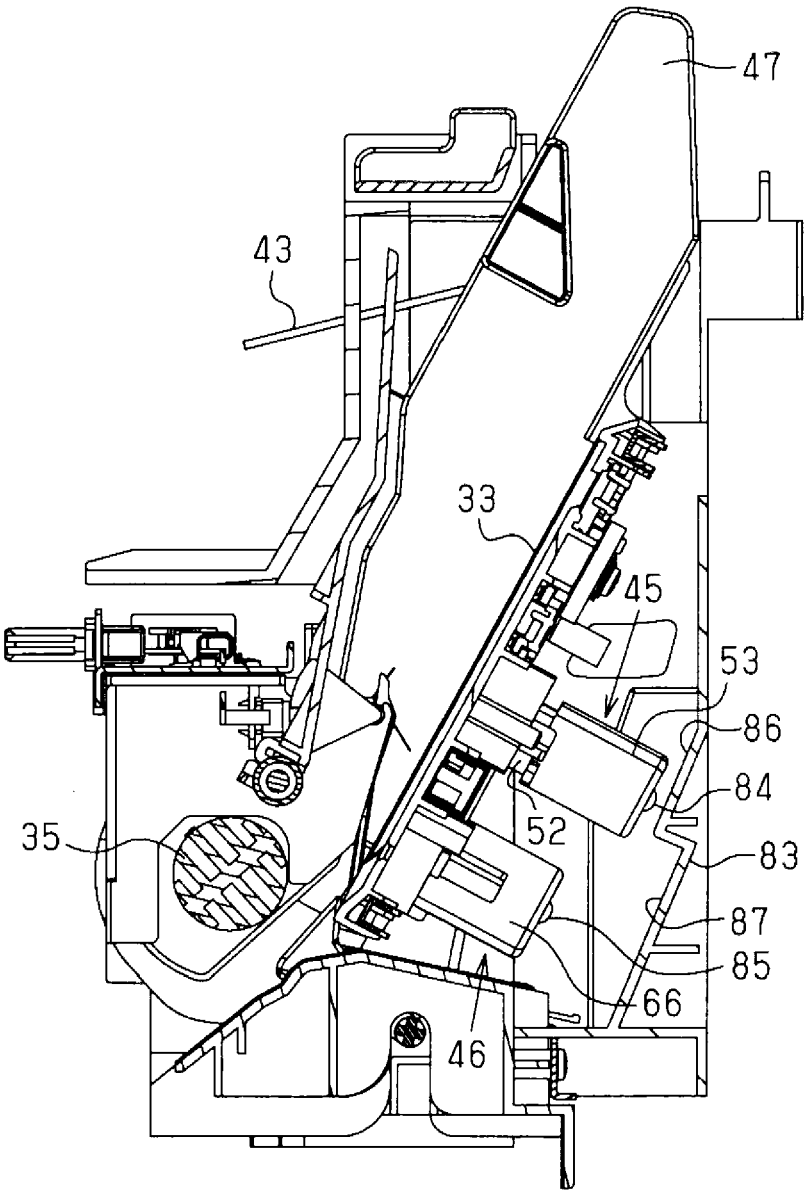
FIG. 22 is a cross-sectional view illustrating a state in which the predetermined number or less of medium-size sheets of paper are placed on the placement unit.

In the present embodiment, as illustrated in FIG. 22, if the number of the sheets P placed on the placement unit 33 is less than or equal to a predetermined number, the placement unit 33 is configured to be pushed up only by the urging forces of the torsion coil springs 43 even if the size of the sheets P is medium. With this configuration, the first thrust mechanism 45 in operation is separated from the abutment plate 83, and the push-up force of the first thrust mechanism 45 stops acting on the placement unit 33. In this case, the second thrust mechanism 46 does not operate.

Figure 23:
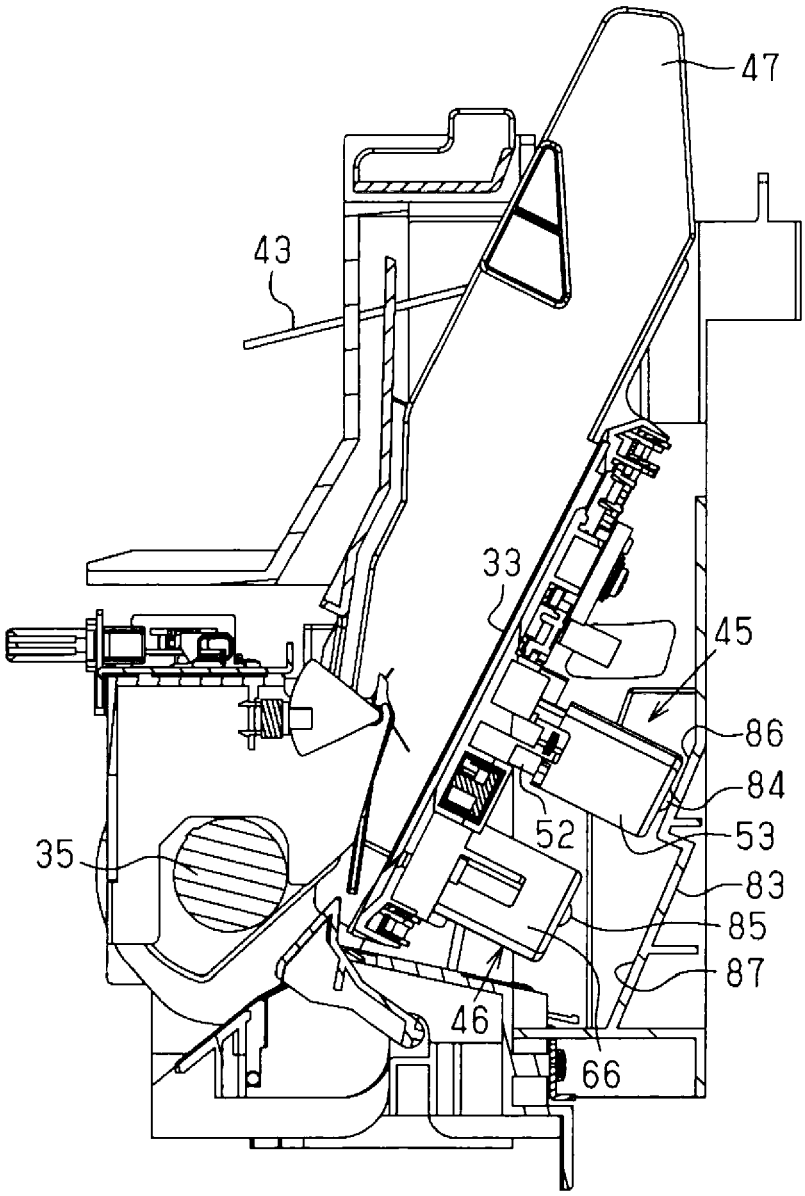
FIG. 23 is a cross-sectional view illustrating a state in which thirty medium-size sheets of paper are placed on the placement unit.

For example, as illustrated in FIG. 23, in a case in which thirty medium size sheets P of a basis weight of 80 g/m$^2$ are placed on the placement unit 33, the first thrust mechanism 45 in operation abuts the abutment plate 83, and the push-up force thereof acts on the placement unit 33. In this case, the second thrust mechanism 46 does not operate.

Figure 24:
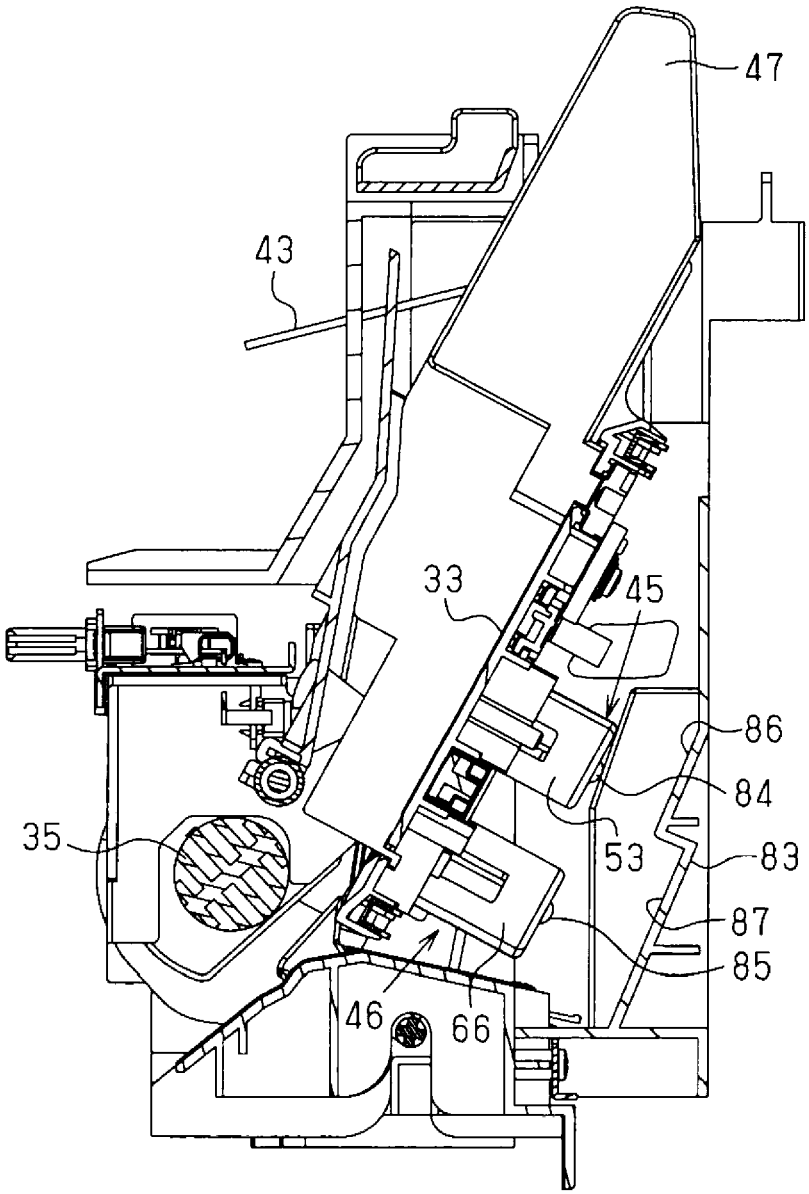
FIG. 24 is a cross-sectional view illustrating a state in which small-size sheets of paper are placed on the placement unit.

In the present embodiment, as illustrated in FIG. 24, if the size of the sheets P placed on the placement unit 33 is small, the placement unit 33 is pushed up only by the urging forces of the torsion coil springs 43. In this case, the first thrust mechanism 45 and the second thrust mechanism 46 do not operate and are separated from the abutment plate 83. Note that in the present embodiment, as illustrated in FIG. 25, when the placement unit 33 stays at the standby position, the first thrust mechanism 45 and the second thrust mechanism 46 do not operate and are in contact with the abutment plate 83.

According to the embodiment described in detail above, the following advantageous effects can be provided. In the ink jet type printer 11, the first coil spring 51 that imparts an urging force to the placement unit 33 is covered by the first upper case 52 and the second upper case 53, whereas the second coil spring 64 that imparts an urging force to the placement unit 33 is covered by the first lower case 65 and the second lower case 66. With this configuration, the first coil spring 51 and the second coil spring 64 can be protected.

The ink jet type printer 11 includes the torsion coil springs 43 that urge the placement unit 33 and the sheets P placed thereon toward the feed roller 35. With this configuration, the urging forces imparted to the placement unit 33 can be set suitably to fit sheets P of a plurality of sizes.

The ink jet type printer 11 causes the first thrust mechanism 45 and the second thrust mechanism 46 selectively restrain the first coil spring 51 and the second coil spring 64 from imparting the urging forces to the placement unit 33 in accordance with the position to which the slide member 50 has been moved. With this configuration, a single slide member 50 can selectively restrain two thrust mechanisms 44 (i.e., the first thrust mechanism 45 and the second thrust mechanism 46) from functioning, which leads to a reduction in the number of parts.

In the ink jet type printer 11, in the case in which a pair of the edge guides 47 are moved from the positions away from each other to the positions closer to each other, the second thrust mechanism 46, which is one of the two thrust mechanisms 44 that is located further away from the pivot shafts 42 in the direction orthogonally intersecting the axial direction of the pivot shafts 42, restrains of the second coil spring 64 from imparting the urging force to the placement unit 33 before the first thrust mechanism 45, which is one of the thrust mechanisms 44 that is closer to the pivot shafts 42 in the direction orthogonally intersecting the axial direction of the pivot shafts 42, restrains the first coil spring 51 from imparting the urging force to the placement unit 33. With this configuration, when the first thrust mechanism 45 and the second thrust mechanism 46 push up the placement unit 33 and the sheets P placed thereon toward the feed roller 35, the push-up forces can be adjusted appropriately in accordance with the size of the sheets P.

In the ink jet type printer 11, the second coil spring 64 of the second thrust mechanism 46, which is one of the two thrust mechanisms 44 that is located further away from the pivot shafts 42 in the direction orthogonally intersecting the axial direction of the pivot shafts 42, provides a larger urging force than the first coil spring 51 of the first thrust mechanism 45, which is one of the thrust mechanisms 44 that is closer to the pivot shafts 42 in the direction orthogonally intersecting the axial direction of the pivot shafts 42. With this configuration, when the placement unit 33 is rotated around the pivot shafts 42, the urging force of the second coil spring 64 in particular can be imparted to the placement unit 33 efficiently because of the leverage effect.

In the ink jet type printer 11, the first projection 84 that is a portion of the second upper case 53 that comes into contact with the first abutment surface 86 is shaped like a hemisphere, and the second projection 85 that is a portion of the second lower case 66 that comes into contact with the second abutment surface 87 is also shaped like a hemisphere. With this configuration, even if respective contact angles of the first projection 84 and the second projection 85 against the first abutment surface 86 and the second abutment surface 87 change slightly, changes in the respective urging forces of the first coil spring 51 and the second coil spring 64 that act on the placement unit 33 can be suppressed.

In the ink jet type printer 11, in the state in which the placement unit 33 and the sheets P placed thereon are pushed up toward the feed roller 35 by the push-up forces of the first thrust mechanism 45 and the second thrust mechanism 46, a pair of the edge guides 47 are permitted to move in the direction away from each other. With this configuration, when a sheet P is jammed between a pair of the edge guides 47, a pair of the edge guides 47 can be moved in the direction away from each other so that the jammed sheet P can be removed easily.

In the ink jet type printer 11, in the state in which the placement unit 33 and the sheets P placed thereon are pushed up toward the feed roller 35 by the push-up forces of the first thrust mechanism 45 and the second thrust mechanism 46, the first restraining portions 62 and the second restraining portions 75 restrain the first restrained plates 60 and the second restrained plates 73 from rotating, respectively, and a pair of the edge guides 47 are thereby restrained from moving in the direction closer to each other. With this configuration, after the second upper case 53 and the second lower case 66 move relative to the first upper case 52 and the first lower case 65, respectively, the first restrained plates 60 and the second restrained plates 73 can be restrained from overlapping the first restraining portions 62 and the second restraining portions 75 in the relative movement direction. This restrains the second upper case 53 and the second lower case 66 from failing to return to the original positions before the relative movement.

In the ink jet type printer 11, the first upper case 52 has the first upper elongated protrusion 56, which extends in the urging direction of the first coil spring 51, whereas the second upper case 53 has the second upper groove 57, which extends in the urging direction of the first coil spring 51 and engages the first upper elongated protrusion 56. In addition, the first lower case 65 has the first lower elongated protrusion 69, which extends in the urging direction of the second coil spring 64, whereas the second lower case 66 has the second lower groove 70, which extends in the urging direction of the second coil spring 64 and engages the first lower elongated protrusion 69. With this configuration, the second upper case 53 can move relative to the first upper case 52 in the urging direction of the first coil spring 51, while the first upper case 52 and the second upper case 53 can rotate together in the rotation direction of the first upper rotating protrusion 58. In addition, the second lower case 66 can move relative to the first lower case 65 in the urging direction of the second coil spring 64, while the first lower case 65 and the second lower case 66 can rotate together in the rotation direction of the first lower rotating protrusion 71. This restrains the first upper rotating protrusion 58 of the first upper case 52 from being shifted in phase in the rotation direction from the first restrained plates 60 of the second upper case 53, and also restrains the first lower rotating protrusion 71 of the first lower case 65 from being shifted in phase in the rotation direction from the second restrained plates 73 of the second lower case 66.

Modification Examples

Note that the embodiments described above may be modified as follows. The first upper case 52 and the first lower case 65 may be provided with the second upper groove 57 and the second lower groove 70, respectively, while the second upper case 53 and the second lower case 66 may be provided with the first upper elongated protrusion 56 and the first lower elongated protrusion 69.

The second upper groove 57 and the second lower groove 70 may be replaced with a first notch and a second notch that engage the first upper elongated protrusion 56 and the first lower elongated protrusion 69, respectively. The second upper case 53 and the second lower case 66 may be provided with the first upper elongated protrusion 56 and the first lower elongated protrusion 69, respectively, while the first upper case 52 and the first lower case 65 may be provided with a first notch and a second notch that engage the first upper elongated protrusion 56 and the first lower elongated protrusion 69.

In the state in which the placement unit 33 and the sheets P placed thereon are pushed up toward the feed roller 35 by the first thrust mechanism 45 and the second thrust mechanism 46, a pair of the edge guides 47 need not be restrained from moving in the direction closer to each other.

In the state in which the placement unit 33 and the sheets P placed thereon are pushed up toward the feed roller 35 by the first thrust mechanism 45 and the second thrust mechanism 46, a pair of the edge guides 47 need not be permitted to move in the direction away from each other.

The first projection 84 that is a portion of the second upper case 53 that comes into contact with the first abutment surface 86 need not be shaped like a hemisphere, and the second projection 85 that is a portion of the second lower case 66 that comes into contact with the second abutment surface 87 need not be shaped like a hemisphere, either.

The second coil spring 64 of the second thrust mechanism 46 need not provide a larger urging force than the first coil spring 51 of the first thrust mechanism 45. In the case in which a pair of the edge guides 47 are moved from the positions away from each other to the positions closer to each other, the second thrust mechanism 46 need not restrain the second coil spring 64 from imparting the urging force to the placement unit 33 before the first thrust mechanism 45 restrains the first coil spring 51 from imparting the urging force to the placement unit 33.

Two slide members 50 may be provided in the placement unit 33 so as to engage the first thrust mechanism 45 and the second thrust mechanism 46, and the two slide members 50 may selectively restrain the first coil spring 51 of the first thrust mechanism 45 and the second coil spring 64 of the second thrust mechanism 46 from imparting the urging forces to the placement unit 33 in accordance with respective positions to which the two slide members 50 have been moved.

The slide member 50 may be omitted. In this case, the edge guides 47 are configured to directly engage the first thrust mechanism 45 and the second thrust mechanism 46 and accordingly to have the same functions as the slide member 50.

The entire disclosure of Japanese Patent Application No. 2018-035275, filed Feb. 28, 2018 is expressly incorporated by reference herein.

What is claimed is:

1. A recording apparatus comprising:

a placement unit on which a recording medium is placed;

a feeder that feeds the recording medium from the placement unit toward a recording section;

a thrust mechanism that pushes up the placement unit toward the feeder; and an edge guide that is disposed in the placement unit and defines a position of a side of the recording medium in a direction intersecting a transport direction of the recording medium, wherein the thrust mechanism includes an urging member that imparts an urging force to the placement unit, a first accommodation body that is mounted on the placement unit and receives the urging member from an end thereof and accommodates the urging member, and a second accommodation body that is disposed so as to partially overlap the first accommodation body and receives the urging member from another end thereof and accommodates the urging member, and the first accommodation body and the second accommodation body are movable relative to each other in an urging direction of the urging member and are rotatable together in a circumferential direction of the first accommodation body and the second accommodation body, a protrusion that is disposed in the first accommodation body and that rotates the first accommodation body in conjunction with movement of the edge guide;

a restraining portion that is disposed in the placement unit; and a restrained portion that is disposed in the second accommodation body, that rotates together with the second accommodation body in conjunction with rotation of the first accommodation body, and that is displaced between a first position at which the restraining portion restrains the restrained portion and a second position at which the restraining portion does not restrain the restrained portion, wherein in a case in which the restrained portion is at the first position, the second accommodation body is restrained from moving relative to the first accommodation body, and the urging member is thereby restrained from imparting the urging force to the placement unit.

2. The recording apparatus according to claim 1, further comprising a second urging member that urges the placement unit and the recording medium placed on the placement unit toward the feeder.

3. The recording apparatus according to claim 1, further comprising:

two thrust mechanisms; and a slide member that moves in conjunction with movement of the edge guide and is able to come into contact with the respective protrusions of the two thrust mechanisms, wherein the slide member selectively restrains the respective urging members of the two thrust mechanisms from imparting the urging forces to the placement unit in accordance with a position to which the slide member has been moved.

4. The recording apparatus according to claim 3, wherein the placement unit is configured to be rotatable around a pivot shaft, the two thrust mechanisms are arranged adjacent to each other in a direction orthogonally intersecting an axial direction of the pivot shaft, and in a case in which a pair of the edge guides are moved from positions that are away from each other to positions that are closer to each other, the urging member of one of the two thrust mechanisms that is located further away from the pivot shaft in the direction orthogonally intersecting the axial direction of the pivot shaft is restrained from imparting the urging force to the placement unit before the urging member of another one of the two thrust mechanisms that is located closer to the pivot shaft in the direction orthogonally intersecting the axial direction of the pivot shaft is restrained from imparting the urging force to the placement unit.

5. The recording apparatus according to claim 3, wherein the placement unit is configured to be rotatable around the pivot shaft, the two thrust mechanisms are arranged adjacent to each other in the direction orthogonally intersecting an axial direction of a pivot shaft, and the urging member of one of the two thrust mechanisms that is located further away from the pivot shaft in the direction orthogonally intersecting the axial direction of the pivot shaft provides a larger urging force than the urging member of another one of the two thrust mechanisms that is located closer to the pivot shaft in the direction orthogonally intersecting the axial direction of the pivot shaft.

6. The recording apparatus according to claim 1, further comprising:

an abutment portion with which the second accommodation body comes into contact in a case in which the urging member imparts the urging force to the placement unit, wherein the second accommodation body has a contact portion that is shaped like a hemisphere and comes into contact with the abutment portion.

7. The recording apparatus according to claim 1, wherein in a state in which the placement unit and the recording medium placed thereon are pushed up toward the feeder by the thrust mechanism, a pair of edge guides are permitted to move in a direction away from each other.

8. The recording apparatus according to claim 1, wherein in a state in which the placement unit and the recording medium placed thereon are pushed up toward the feeder by the thrust mechanism, the restraining portion restrains the restrained portion from rotating, and a pair of the edge guides are thereby restrained from moving in a direction closer to each other.

9. The recording apparatus according to claim 1, wherein the first accommodation body has a first engagement portion that extends in an urging direction of the urging member, and the second accommodation body has a second engagement portion that extends in the urging direction of the urging member and that engages the first engagement portion.

10. A recording apparatus comprising:

a placement unit on which a recording medium is placed;

a feeder that feeds the recording medium from the placement unit toward a recording section;

a thrust mechanism that pushes up the placement unit toward the feeder; and an edge guide that is disposed in the placement unit and defines a position of a side of the recording medium in a direction intersecting a transport direction of the recording medium, wherein the thrust mechanism includes:

an urging member that imparts an urging force to the placement unit, a first accommodation body that is mounted on the placement unit and receives the urging member from an end thereof and accommodates the urging member, and a second accommodation body that is disposed so as to partially overlap the first accommodation body and receives the urging member from another end thereof and accommodates the urging member, and the first accommodation body and the second accommodation body are movable relative to each other in an urging direction of the urging member and are rotatable together in a circumferential direction of the first accommodation body and the second accommodation body, an abutment portion with which the second accommodation body comes into contact in a case in which the urging member imparts the urging force to the placement unit, wherein the second accommodation body has a contact portion that is shaped like a hemisphere and comes into contact with the abutment portion.

11. A recording apparatus comprising:

a placement unit on which a recording medium is placed;

a feeder that feeds the recording medium from the placement unit toward a recording section;

a thrust mechanism that pushes up the placement unit toward the feeder; and an edge guide that is disposed in the placement unit and defines a position of a side of the recording medium in a direction intersecting a transport direction of the recording medium, wherein the thrust mechanism includes:

an urging member that imparts an urging force to the placement unit, a first accommodation body that is mounted on the placement unit and receives the urging member from an end thereof and accommodates the urging member, and a second accommodation body that is disposed so as to partially overlap the first accommodation body and receives the urging member from another end thereof and accommodates the urging member, and the first accommodation body and the second accommodation body are movable relative to each other in an urging direction of the urging member and are rotatable together in a circumferential direction of the first accommodation body and the second accommodation body, two thrust mechanisms; and a slide member that moves in conjunction with movement of the edge guide and is able to come into contact with the respective protrusions of the two thrust mechanisms, wherein the slide member selectively restrains the respective urging members of the two thrust mechanisms from imparting the urging forces to the placement unit in accordance with a position to which the slide member has been moved.

* * * * *